US011022908B2

(12) United States Patent
Yamamoto et al.

(10) Patent No.: US 11,022,908 B2
(45) Date of Patent: Jun. 1, 2021

(54) IMAGE FORMING APPARATUS

(71) Applicant: CANON KABUSHIKI KAISHA, Tokyo (JP)

(72) Inventors: Shoji Yamamoto, Kanagawa (JP); Akira Yoshimura, Shizuoka (JP); Shogo Nagamine, Kanagawa (JP); Naoki Matsushita, Shizuoka (JP); Yoshihiko Tanaka, Shizuoka (JP); Hisanori Kobayashi, Kanagawa (JP); Takatoshi Tanaka, Shizuoka (JP); Mitsuhiro Ohta, Kanagawa (JP); Hiroki Katayama, Shizuoka (JP); Akitoshi Toyota, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/080,590

(22) Filed: Oct. 26, 2020

(65) Prior Publication Data

US 2021/0132521 A1 May 6, 2021

(30) Foreign Application Priority Data

Oct. 30, 2019 (JP) ..... JP2019-197460
Dec. 25, 2019 (JP) ..... JP2019-234670
Aug. 31, 2020 (JP) ..... JP2020-146177

(51) Int. Cl.
*G03G 15/04* (2006.01)

(52) U.S. Cl.
CPC ..... *G03G 15/04072* (2013.01); *G03G 2215/0404* (2013.01)

(58) Field of Classification Search
CPC ..... G03G 15/04072; G03G 2215/0404
See application file for complete search history.

(56) References Cited

U.S. PATENT DOCUMENTS 9,581,929 B2 * 2/2017 Nagatoshi ..... G03G 15/043

FOREIGN PATENT DOCUMENTS

JP 2013003329 A 1/2013

* cited by examiner

*Primary Examiner* — Susan S Lee
(74) *Attorney, Agent, or Firm* — Canon U.S.A., Inc. I.P. Division

(57) ABSTRACT

An image forming apparatus to form an image on a recording material includes a photosensitive member, an exposure device to form a latent image on the photosensitive member, a tubular body defining a space in which at least a part of the exposure device is contained, and a support portion that supports the exposure device and is provided along a rotation axis direction of the photosensitive member in the space of the tubular body. The image forming apparatus further includes, in the rotation axis direction, a first side plate fixed to one end portion of the tubular body, and a second side plate fixed to another end portion of the tubular body. One support portion end portion in the rotation axis direction is fixed to the first side plate, and another support portion end portion in the rotation axis direction is fixed to the second side plate.

9 Claims, 16 Drawing Sheets

IMAGE FORMING APPARATUS

BACKGROUND

Field

The present disclosure relates to an electrophotographic image forming apparatus.

Description of the Related Art

An image forming apparatus adopting an electrophotographic image forming process forms a latent image by scanning a laser beam, which is emitted from a laser scanner, along an axis direction of a photosensitive drum on a surface of the photosensitive drum. While the laser beam is scanned in a main scanning direction, the photosensitive drum is rotated. Accordingly, the laser beam that is being scanned in the main scanning direction is sequentially scanned in a sub-scanning direction that is orthogonal to the main scanning direction, thereby forming the latent image. At this time, when the laser scanner vibrates in the sub-scanning direction, an irradiation position of the laser beam on the surface of the photosensitive drum is also shifted in the sub-scanning direction. As a result, the latent image is moved (shifted) in the sub-scanning direction from the originally intended position and is formed thereat. The shift in the sub-scanning direction appears on an image as a blur or as banding. Therefore, there has been a demand for a configuration of the scanner unit which is less liable to vibrate in the sub-scanning direction. In view of such demand, for example, there has been proposed a configuration in which a hollow elastic member and a plate spring are used for a coupling portion between a main body frame and a scanner unit so that vibration that occurs in the main body frame is less liable to propagate to the scanner unit (for example, Japanese Patent Application Laid-Open No. 2013-003329).

The related-art image forming apparatus needs a large number of components such as the elastic member and the plate spring. Therefore, the configuration thereof is complicated, thereby causing an increase in cost. Therefore, there has been a demand for improving the rigidity against vibration while achieving reduction in the number of components and cost.

SUMMARY

The present disclosure has been made to address the vibration rigidity of a scanner unit with a simple configuration.

According to an aspect of the present disclosure, an image forming apparatus configured to form an image on a recording material, the image forming apparatus includes a photosensitive member, an exposure device configured to form a latent image on the photosensitive member, a tubular body defining a space in which at least a part of the exposure device is contained, a support portion which is provided along a rotation axis direction of the photosensitive member in the space of the tubular body, and is configured to support the exposure device, a first side plate fixed to one end portion of the tubular body in the rotation axis direction, and a second side plate fixed to another end portion of the tubular body in the rotation axis direction, wherein one end portion of the support portion in the rotation axis direction is fixed to the first side plate, and another end portion of the support portion in the rotation axis direction is fixed to the second side plate.

Further features of the present disclosure will become apparent from the following description of exemplary embodiments with reference to the attached drawings.

DESCRIPTION OF THE EMBODIMENTS

Now, modes for carrying out the present disclosure are described in detail with reference to the drawings based on the following embodiments.

First Embodiment

[Overall Configuration of Image Forming Apparatus]

Figure 1:
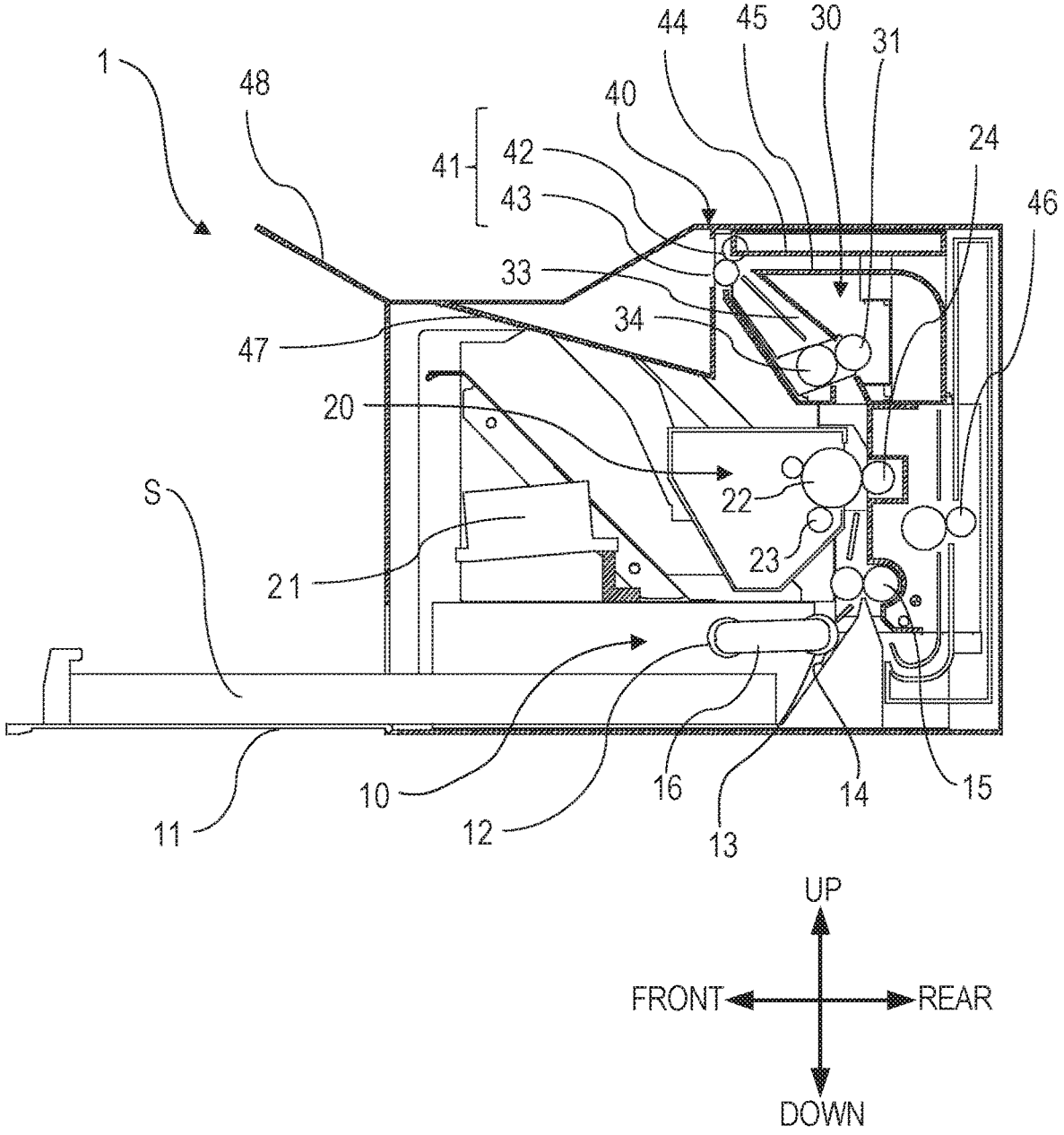
FIG. 1 is a sectional view for illustrating an image forming apparatus according to a first embodiment and a second embodiment.

With reference to FIG. 1, an overview of an overall configuration of an image forming apparatus is described. Examples of the image forming apparatus include an electrophotographic copying machine, an electrophotographic printer (such as an LED printer and a laser beam printer), an electrophotographic facsimile apparatus, and an electrophotographic word processor. Further, examples of the image forming apparatus include a mono-color or full-color image forming apparatus that is used as an output device such as a multifunction peripheral or a workstation having a function to form an image on a recording material. FIG. 1 is a sectional view for illustrating a schematic configuration of a laser beam printer (hereinafter referred to as "printer") 1, which is an example of the image forming apparatus. The recording material is a material on which an image is to be formed by an electrophotographic image forming apparatus, and examples of the recording material include a paper sheet and an OHP sheet.

The printer 1 includes a recording-material supplying portion 10, an image forming portion 20, an image fixing portion 30, and a recording-material delivery portion 40. The recording-material supplying portion 10 is configured to supply a recording material S. The image forming portion 20 is configured to perform image formation on the supplied recording material S. The image fixing portion 30 is configured to fix the formed image on the recording material S. The recording-material delivery portion 40 is configured to deliver the recording material S having the image fixed thereon to an outside of the printer 1. The recording-material supplying portion 10 is arranged on a lower side in the printer 1 and is configured to accommodate the recording material S. The recording-material supplying portion 10 mainly includes a feed roller 12, a conveyance roller 13, a separation roller 14, and a registration roller pair 15 and is configured to supply the accommodated recording material S to the image forming portion 20.

The image forming portion 20 includes a cartridge, a laser scanner 21, and a transfer roller 24 and is configured to perform image formation on the recording material S. The cartridge includes a photosensitive drum 22, which is a photosensitive member, and a developing sleeve 23. The laser scanner 21 is an exposure device. The laser scanner 21 includes a light source and is configured to irradiate a surface of the photosensitive drum 22 with a laser beam. The transfer roller 24 is opposed to the photosensitive drum 22 and is configured to transfer a toner image to the recording material S. The image fixing portion 30 is configured to heat and fix an unfixed toner image by allowing the recording material S to pass through a nip portion defined by a fixing-pressure roller 31 and a fixing-heating roller 34, which includes a fixing heater (not shown) provided therein. At the recording-material delivery portion 40, the recording material S having the toner image heated and fixed thereon is delivered to the outside of the printer 1 by a conveyance force of a delivery roller pair 41 and is then placed on a delivery tray 47 and a delivery extension tray 48. Here, the left side of FIG. 1 on which a feed tray 11 and the delivery extension tray 48 are provided is referred to as "FRONT (front face)", and the right side of FIG. 1 on which a duplex-printing conveyance passage is provided is referred to as "REAR (rear face)". Moreover, the upper side of FIG. 1 on which the delivery extension tray 48 is provided is referred to as "UP", and the lower side of FIG. 1 on which the feed tray 11 is provided is referred to as "DOWN". Further, the left side defined when the printer 1 is seen toward the front face is referred to as "LEFT", and the right side is referred to as "RIGHT" (see, for example, FIG. 3).

[Description of Operation of Image Forming Apparatus]

An image forming operation of the printer 1 having the above-mentioned configuration is described. First, based on an image signal from a controller (not shown) which is provided to the printer 1 and has received a print command, a laser beam is radiated from the laser scanner 21 to the photosensitive drum 22. The photosensitive drum 22 rotates counterclockwise, and is cleaned by a cleaning device (not shown) and irradiated with a laser beam on a uniformly charged surface thereof. An electrostatic latent image formed on the photosensitive drum 22 through irradiation with the laser beam is developed with toner on the developing sleeve 23, and therefore a toner image is formed on the surface of the photosensitive drum 22.

The feed roller 12 starts rotating counterclockwise at a predetermined timing. After that, when a command for starting feeding is received from the controller, a feed arm 16 is lowered counterclockwise about the conveyance roller 13. The feed roller 12 is brought into abutment against the uppermost sheet of a bundle of recording materials S accommodated in the feed tray 11 and conveys the recording material S to the conveyance roller 13 with a friction force. After the conveyance to the conveyance roller 13 is terminated, the feed arm 16 is raised reversely, that is, clockwise so that the feed roller 12 separates away from the recording material S. When a plurality of recording materials S are simultaneously sent out to the conveyance roller 13, only the uppermost sheet is separated by an action of the separation roller 14 and is conveyed to the registration roller pair 15 arranged on downstream.

The recording material S that has been sent from the conveyance roller 13 to the registration roller pair 15 is conveyed to the image forming portion 20 including the photosensitive drum 22 and the transfer roller 24. At the image forming portion 20, the toner image formed on the surface of the photosensitive drum 22 in the above-mentioned manner is transferred to the surface of the recording material S. After that, the recording material S having the unfixed toner image transferred thereto is conveyed to the image fixing portion 30. At the image fixing portion 30, the recording material S passes through a fixing nip portion defined between the fixing-pressure roller 31, which rotates clockwise, and the fixing-heating roller 34, which is rotated counterclockwise by the fixing-pressure roller 31. The fixing-heating roller 34 includes the fixing heater provided therein, and is configured to fix the unfixed toner image on the recording material S by pressurizing the recording material S at the fixing nip portion and heating the recording material S with the fixing heater.

Finally, the recording material S is delivered to the outside of the printer 1 by the delivery roller pair 41. The delivery roller pair 41 is provided at the recording-material delivery portion 40 and defines a nip portion with a delivery driving roller 42, which is configured to rotate clockwise, and a delivery driven roller 43, which is configured to be rotated by the delivery driving roller 42. The recording material S having been delivered is placed on the delivery tray 47 and the delivery extension tray 48, for example, with an image transfer surface thereof facing downward. The delivery tray 47 is arranged below the nip portion of the delivery roller pair 41, and subsequent sheets are sequentially stacked on the recording material S having been delivered.

In a case of performing printing on both front and back faces of the recording material S, after a trailing end of the recording material S having an image formed on a first face thereof passes through the most downstream end of a fixing guide 33, which is provided between the fixing nip portion and the delivery roller pair 41, in the conveyance direction, the rotation direction of the delivery driving roller 42 is reversed and set to the counterclockwise direction. Then, the recording material S enters the duplex-printing conveyance passage formed of a duplex-printing upper guide 44 and a duplex-printing lower guide 45 to be conveyed to a duplex-printing roller pair 46. When the recording material S is no longer present at the nip portion of the delivery roller pair 41, the delivery driving roller 42 starts rotating clockwise again to prepare for delivery of the recording material S having an image formed on a second face. The recording material S is conveyed by the duplex roller pair 46 to the nip portion defined by the registration roller pair 15. After that, image formation for the second face is performed through the same processes as those for the first face of the recording material S.

[Frame Configuration]

Figure 8A:
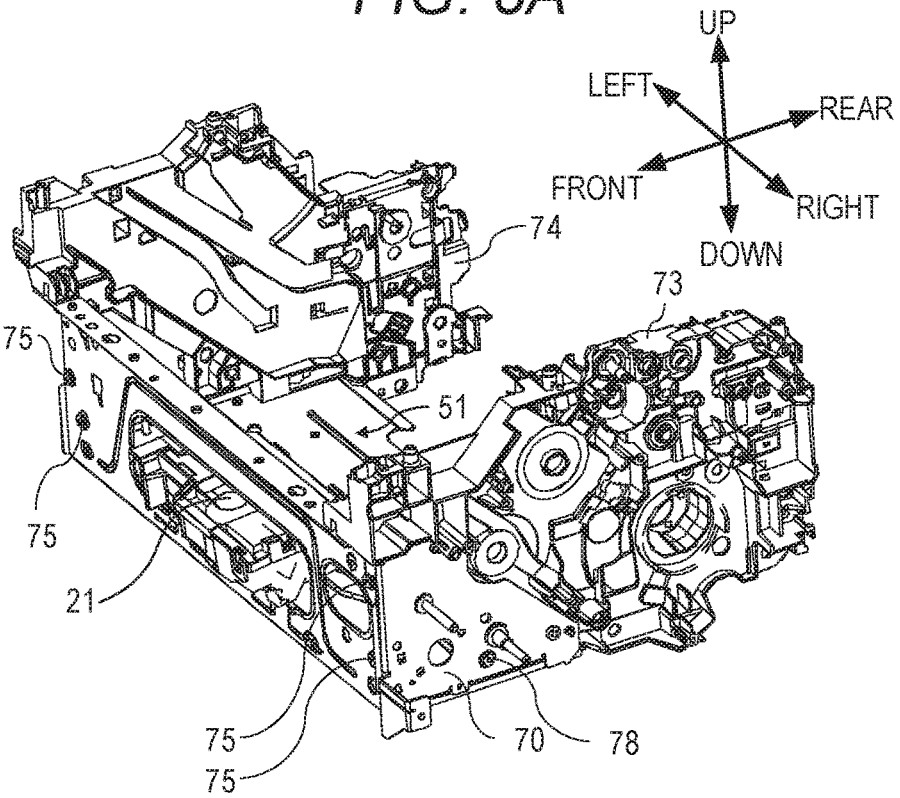
FIG. 8A is a right perspective view for illustrating mounting of the laser scanner of the first embodiment to side plates.
Figure 8B:
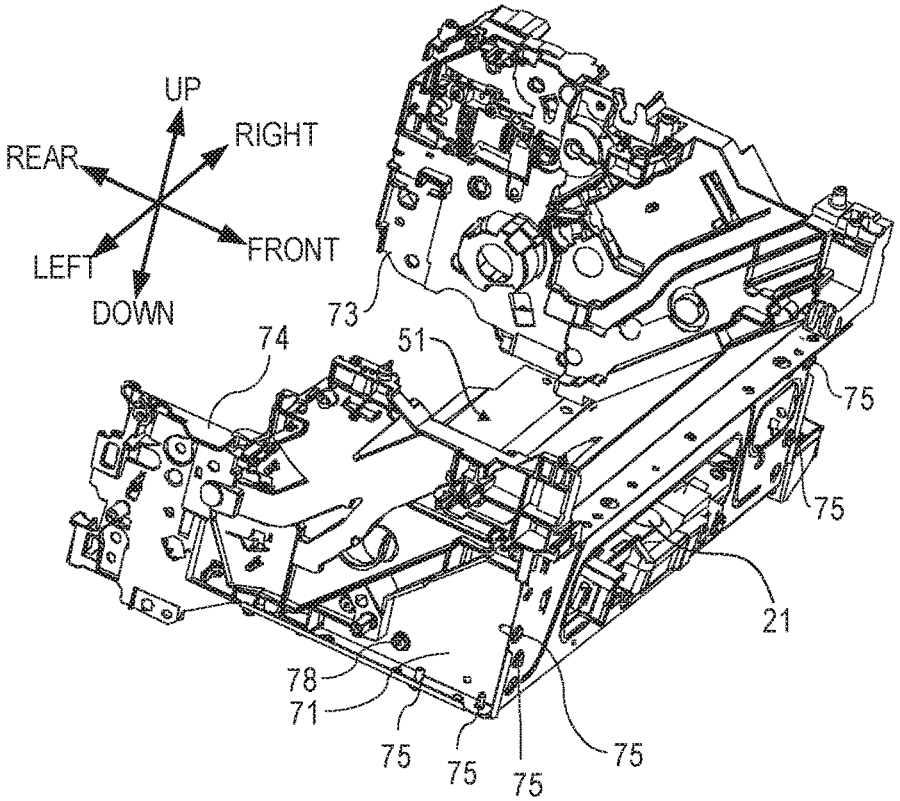
FIG. 8B is a left perspective view for illustrating mounting of the laser scanner of the first embodiment to the side plates.

With reference to FIG. 8A and FIG. 8B, a frame configuration of the printer 1 is described. FIG. 8A is a perspective view for illustrating a right side plate 73, a left side plate 74, and a scanner frame 51 as seen from the right side. FIG. 8B is a perspective view for illustrating the right side plate 73, the left side plate 74, and the scanner frame 51 as seen from the left side. In the frame configuration of the printer 1, the right side plate 73 is provided on the right side of the scanner frame 51 on which the laser scanner 21 is fixed, and the left side plate 74 is provided on the left side of the scanner frame 51. The right side plate 73 and the left side plate 74 are side plates for mounting the image forming portion 20 and the image fixing portion 30, which are described above with reference to FIG. 1. Mounting portions for members such as the photosensitive drum 22 are provided to the right side plate 73 and the left side plate 74, and the right side plate 73 and the left side plate 74 are fixed with respect to the laser scanner 21 so that the members such as the photosensitive drum 22 are positioned with respect to the laser scanner 21.

[Support Configuration for Laser Scanner 21]

(Main Frame and Subframe)

Figure 2:
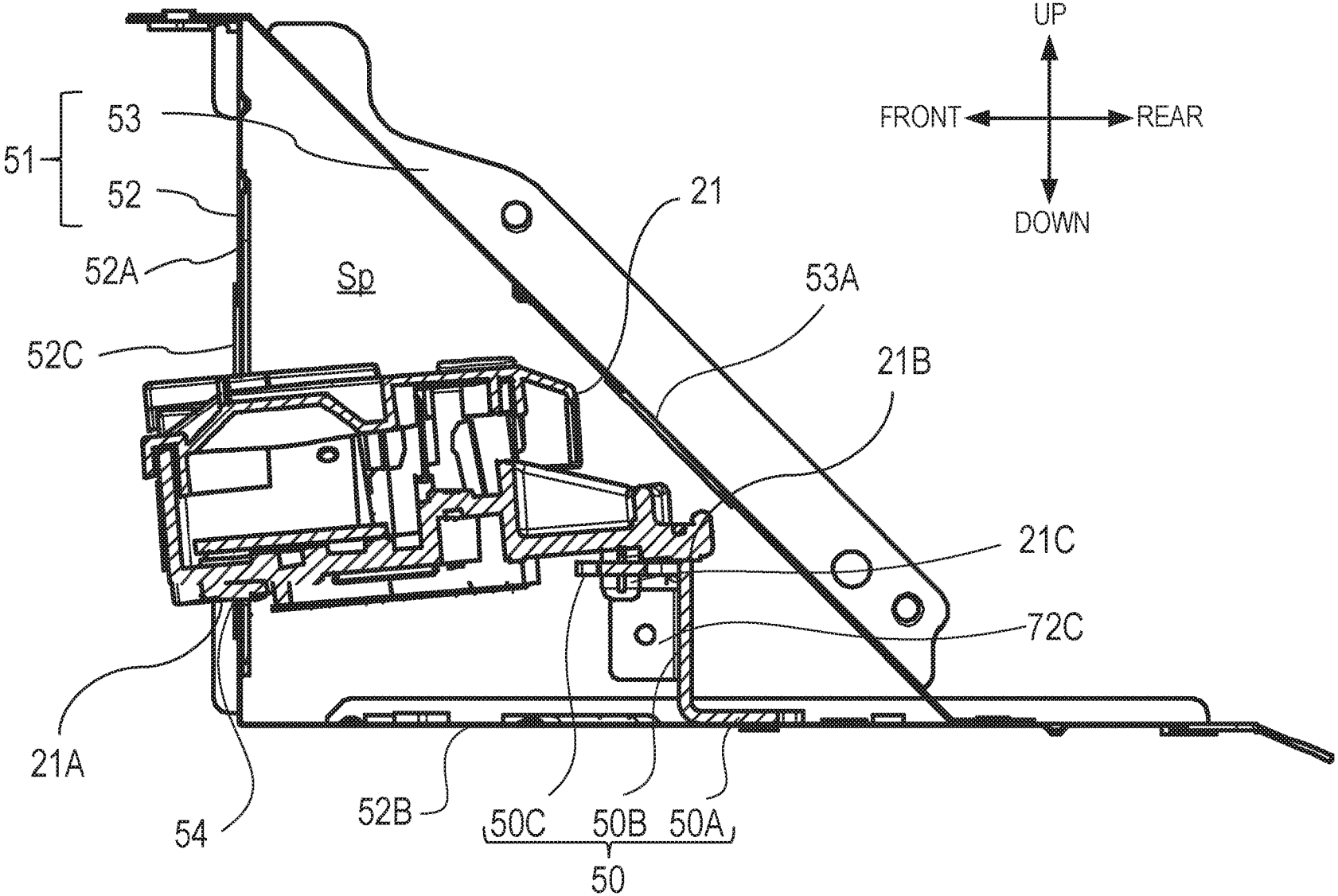
FIG. 2 is a sectional view for illustrating peripheral components provided around a laser scanner of the first embodiment.

A support configuration for the laser scanner 21 of the first embodiment is described with reference to FIG. 2 to FIG. 5. FIG. 2 is a sectional view for illustrating peripheral components provided around the laser scanner 21 of the first embodiment. The scanner frame 51 includes a main frame 52 and a subframe 53. The main frame 52 is a first frame forming two sides of a triangle in a cross section taken along a direction orthogonal to a longitudinal direction (right-and-left direction). The subframe 53 is a second frame forming one side of the triangle. The main frame 52 and the subframe 53 are fastened to each other at a plurality of positions in the longitudinal direction (right-and-left direction). The fastening at the plurality of positions is described later.

As illustrated in FIG. 2, in the scanner frame 51, the main frame 52 and the subframe 53 are fastened to each other. With this, a tubular body having a shape of a triangle in a cross section taken along the direction orthogonal to the longitudinal direction is formed, thereby defining a space Sp for accommodating at least a part of the laser scanner 21. The laser scanner 21 is supported from below at one end by a scanner stay 50 (support portion) provided in the space Sp defined inside the tubular body formed of the main frame 52 and the subframe 53 and at another end by the main frame 52. Details of the support configuration for the laser scanner 21 are described later.

(Scanner Stay)

Figure 3:
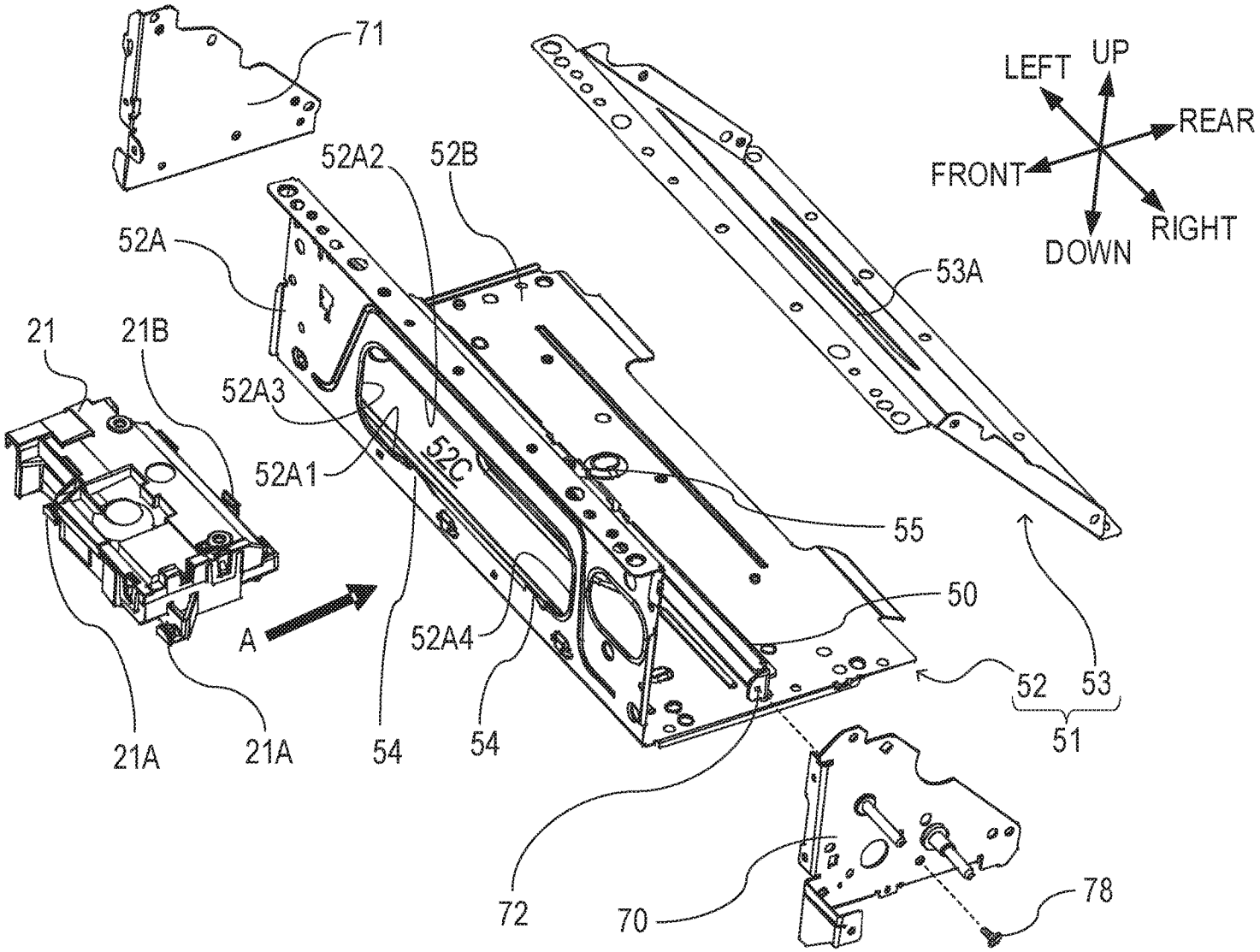
FIG. 3 is an exploded perspective view for illustrating the peripheral components provided around the laser scanner of the first embodiment.
Figure 6:
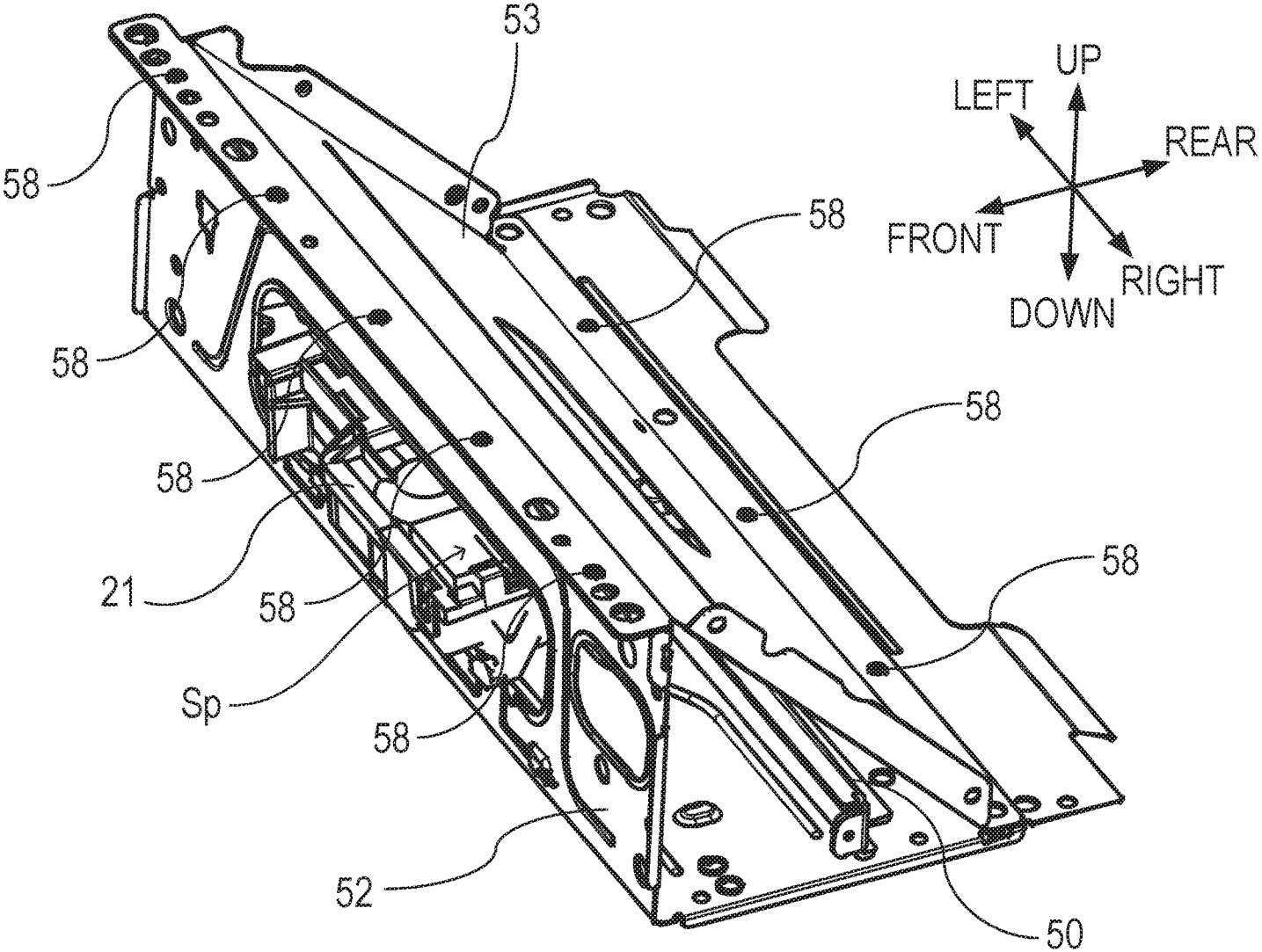
FIG. 6 is an enlarged view for illustrating the peripheral components provided around the laser scanner of the first embodiment.

FIG. 3 is an exploded perspective view for illustrating the peripheral components provided around the laser scanner 21 of the first embodiment. FIG. 6 is a perspective view for illustrating a state in which the laser scanner 21 is arranged on the main frame 52 supporting the scanner stay 50 and is fixed with springs described later, and in which the scanner frame 51 is formed by fastening the subframe 53 to the main frame 52. The scanner stay 50 is provided in the space Sp (FIG. 2 and FIG. 6) of the scanner frame 51 (in the space) to support the laser scanner 21. As illustrated in FIG. 2 and FIG. 3, the shape of a cross section (hereinafter referred to as "sectional shape") (shape of the cross section taken along a direction orthogonal to the right-and-left direction) of the scanner stay 50 is a substantially Z-shape. Moreover, the scanner stay 50 extends in the right-and-left direction, that is, is installed such that a longitudinal direction of the scanner stay 50 matches a rotation axis direction of the photosensitive drum 22 and the right-and-left direction of the printer 1. As a result, the scanner stay 50 has such a shape as to be resistant against vibration and static deformation. The scanner stay 50 includes a fixed portion 50A, a connection portion 50B, and a scanner positioning portion 50C. The fixed portion 50A is fixed to the main frame 52. The connection portion 50B has one end connected to the fixed portion 50A and another end extending away from the fixed portion 50A. The scanner positioning portion 50C is connected to the another end of the connection portion 50B. In the first embodiment, the scanner stay 50 formed of the fixed portion 50A, the connection portion 50B, and the scanner positioning portion 50C has a substantially Z-shaped sectional shape in the cross section taken along the direction orthogonal to the longitudinal direction of the scanner stay 50. Moreover, an angle formed between the fixed portion 50A and the connection portion 50B and an angle formed between the connection portion 50B and the scanner positioning portion 50C are each set to approximately 90° as illustrated in FIG. 2, but the angles are not limited to approximately 90° and may be different angles or angles other than approximately 90°. Moreover, the scanner stay 50 formed of the fixed portion 50A, the connection portion 50B, and the scanner positioning portion 50C may have other sectional shapes such as a substantially U-shaped (square-bracket-shaped) sectional shape in the cross section taken along the direction orthogonal to the longitudinal direction of the scanner stay 50.

(Installation of Laser Scanner)

The main frame 52 includes a first face 52A and a second face 52B (FIG. 2 and FIG. 3). The first face 52A is a first face forming one of the two sides of the triangle in the cross section taken along the direction orthogonal to the longitudinal direction. The second face 52B is a second face forming another one of the two sides of the triangle in the cross section taken along the direction orthogonal to the longitudinal direction. The main frame 52 has a substantially L-shaped sectional shape. The first face 52A functions as a support portion configured to support the laser scanner 21 in the up-and-down direction. The second face 52B is substantially perpendicular to the first face 52A and is configured to support the scanner stay 50. The subframe 53 has an opening 53A for allowing the laser beam to pass therethrough so that the laser beam radiated from the laser scanner 21 is not interrupted. The subframe 53 forms one side of the triangle. That is, the main frame 52 includes the first face 52A extending in the up-and-down direction and the right-and-left direction and the second face 52B extending in the right-and-left direction and the front-and-rear direction, and one end and another end of the subframe 53 are fixed to the first face 52A and the second face 52B of the main frame 52, which are orthogonal to each other. As described above, the above-mentioned space Sp having the triangular sectional shape is formed of the three faces including the first face 52A of the main frame 52, the second face 52B of the main frame 52, and the subframe 53.

Figure 4:
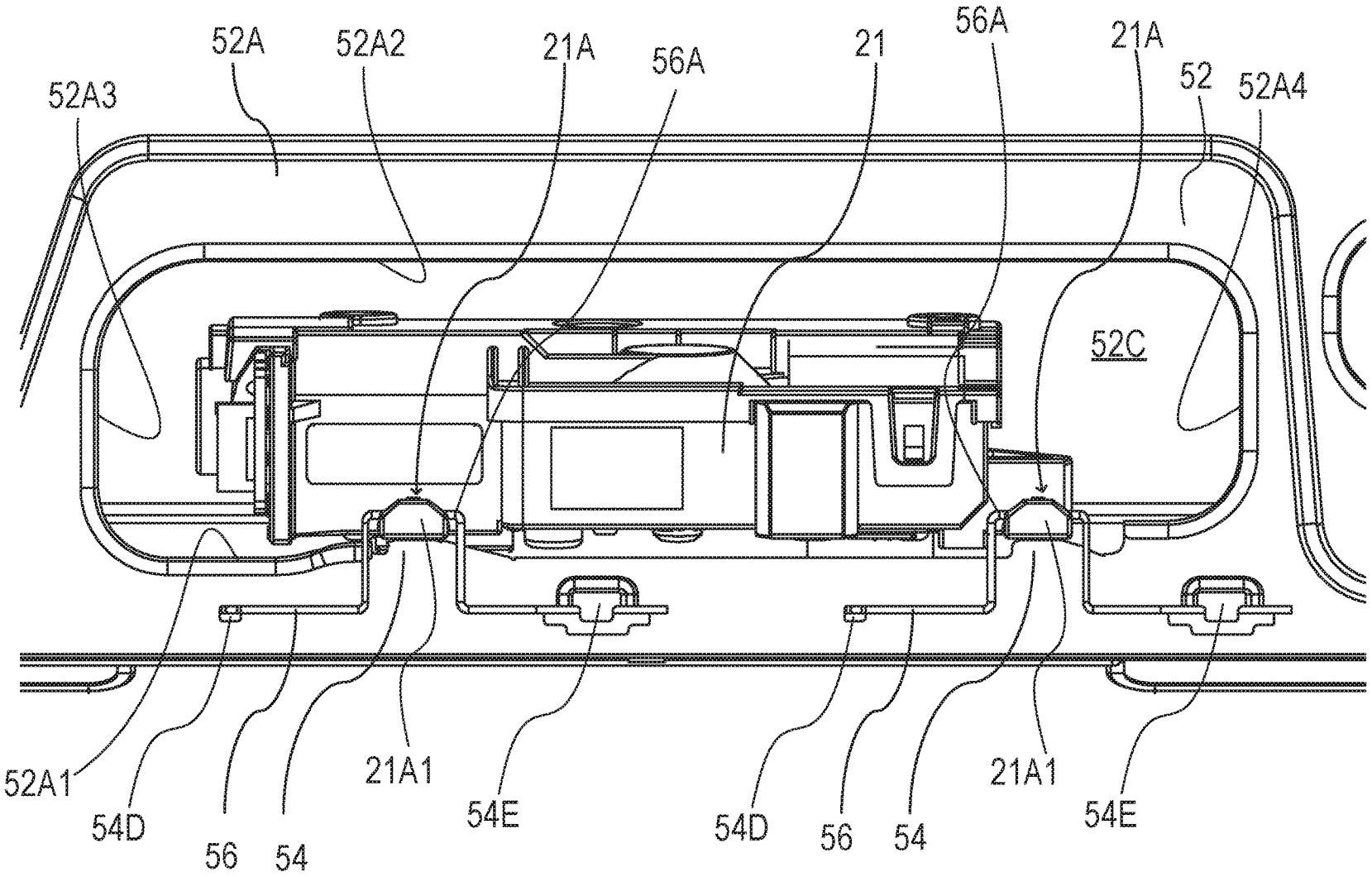
FIG. 4 is a front enlarged view for illustrating a mounting portion for the laser scanner of the first embodiment.

FIG. 4 is a front enlarged view for illustrating the mounting portion for the laser scanner 21 of the first embodiment. As illustrated in FIG. 4, the first face 52A of the main frame 52 has an opening 52C. The opening 52C includes a rim portion 52A1, a rim portion 52A2, a rim portion 52A3, and a rim portion 52A4. The rim portion 52A1 is a lower end extending in the right-and-left direction. The rim portion 52A2 is an upper end extending in the right-and-left direction. The rim portion 52A3 is one end in the right-and-left direction and extends in the up-and-down direction. The rim portion 52A4 is another end in the right-and-left direction and extends in the up-and-down direction. The laser scanner 21 is inserted into the space Sp through the opening 52C from the front face side as indicated by the arrow A of FIG. 3 and is installed on the scanner stay 50. At this time, the scanner positioning portion 50C of the scanner stay 50 has at least two through holes, and two bosses 21C, which are provided to the laser scanner 21 and project downward, pass through the through holes as illustrated in FIG. 2. With this, the laser scanner 21 is allowed to move in the up-and-down direction relative to the scanner positioning portion 50C to be positioned in the front-and-rear direction and the right-and-left direction.

Moreover, frame-side abutting portions 54 each being a first abutting portion are provided to the rim portion 52A1 of the first face 52A of the main frame 52. That is, the frame-side abutting portions 54 are provided on a trailing end side in the direction of inserting the laser scanner 21 into the opening 52C. Further, first abutment portions 21A each being a first abutted portion are provided to the laser scanner 21 on the front face side corresponding to one end portion in the front-and-rear direction. In the first embodiment, the frame-side abutting portions 54 of the first face 52A of the main frame 52 are configured to be brought into abutment against the first abutment portions 21A of the laser scanner 21. More in detail, upper parts of the frame-side abutting portions 54 and lower parts of the first abutment portions 21A are brought into abutment against each other. With this, the front end portion of the laser scanner 21 is positioned in the up-and-down direction.

In FIG. 3 and FIG. 4, the frame-side abutting portions 54 are provided at two positions, and the first abutment portions 21A are provided at two positions. However, the number of positions may be one or three or more.

Figure 5:
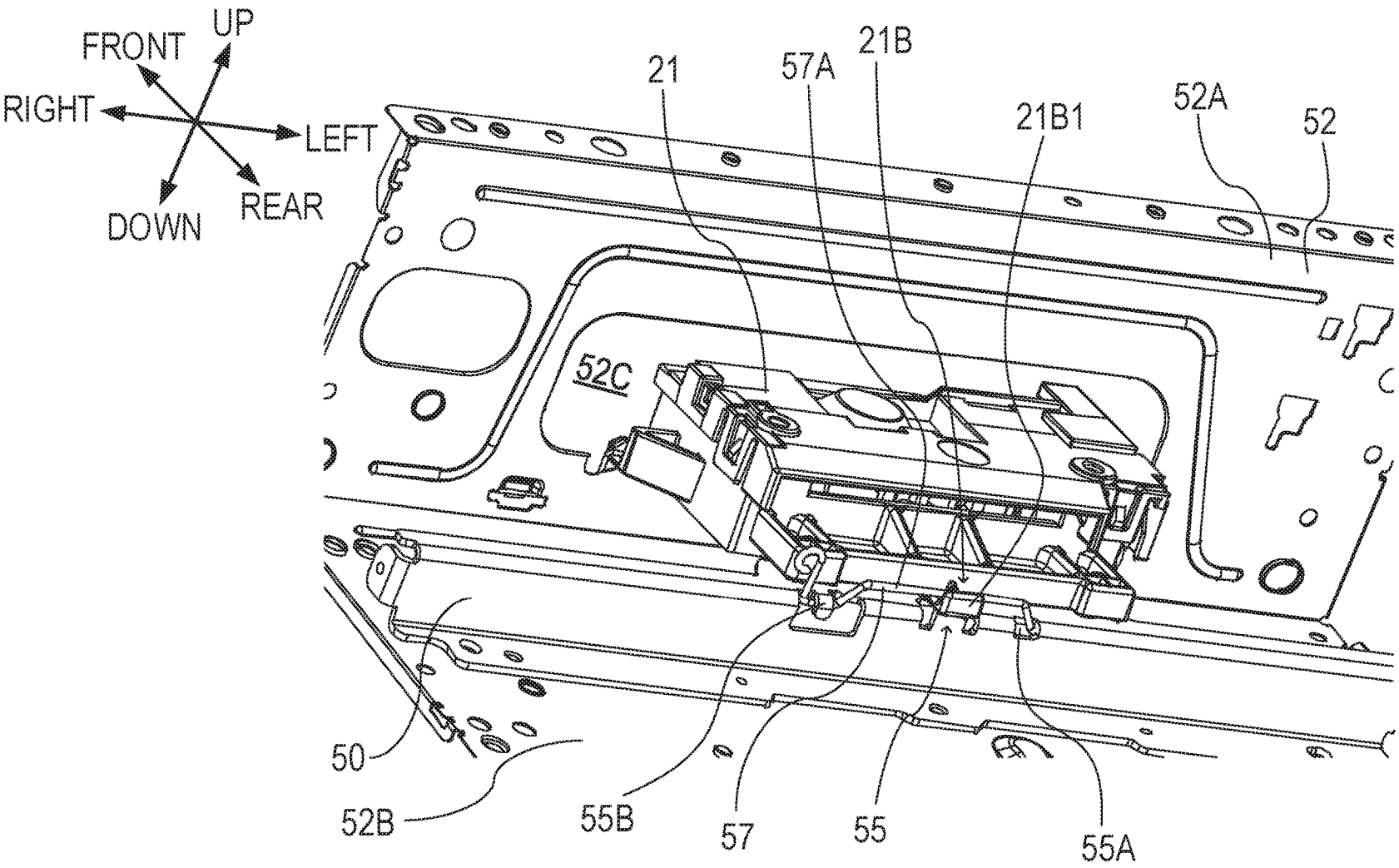
FIG. 5 is a rear perspective view for illustrating the mounting portion for the laser scanner of the first embodiment.

FIG. 5 is a rear enlarged view for illustrating the mounting portion for the laser scanner 21 of the first embodiment. As illustrated in FIG. 5, a second abutment portion 21B being a second abutted portion is provided to the laser scanner 21 on the rear face side corresponding to another end portion in the front-and-rear direction. In other words, the laser scanner 21 includes the second abutment portion 21B on a leading end side in the direction of inserting the laser scanner 21 into the opening 52C. Further, a stay-side abutting portion 55 being a second abutting portion is provided to the scanner stay 50 at a predetermined position in the longitudinal direction (right-and-left direction) so that the stay-side abutting portion 55 is brought into abutment against the second abutment portion 21B of the laser scanner 21. The stay-side abutting portion 55 is not formed in such a manner as to bent from the connection portion 50B of the scanner stay 50 at another end on the side opposite to the one end connected to the fixed portion 50A of the connection portion 50B to serve as the scanner positioning portion 50C, but is formed so as to partially project in the extending direction of the connection portion 50B. When the laser scanner 21 is inserted into the space Sp, and the second abutment portion 21B of the laser scanner 21 and the stay-side abutting portion 55 of the scanner stay 50 are brought into abutment against each other, the rear end portion of the laser scanner 21 is positioned in the up-and-down direction. More in detail, an upper part (end portion) of the stay-side abutting portion 55 and a lower part of the second abutment portion 21B are brought into abutment against each other. In FIG. 3 and FIG. 5, the stay-side abutting portion 55 is provided at one position, and the second abutment portion 21B is provided at one position. However, the number of positions may be two or more. As described above, the frame-side abutting portions 54 are each formed on the first face 52A of the main frame 52 with an open end (edge) and are brought into abutment against the first abutment portions 21A of the laser scanner 21 substantially perpendicularly, and the stay-side abutting portion 55 is formed on the scanner stay 50 with an open end (edge) and is brought into abutment against the second abutment portion 21B of the laser scanner 21 substantially perpendicularly.

(Fixing Laser Scanner)

As illustrated in FIG. 4, the first abutment portions 21A fix the laser scanner 21 by urging the laser scanner 21 downward with restoring forces for elastic deformation of frame-side springs 56 each being a fixing member. A hole 54D and a spring stopper portion 54E are provided in the vicinity of each of the frame-side abutting portions 54 of the first face 52A of the main frame 52. A spring receiving portion 21A1 configured to catch the frame-side spring 56 is provided to each of the first abutment portions 21A of the laser scanner 21. The frame-side springs 56 are, for example, as illustrated in FIG. 4, each a wire spring having an engagement portion (catch portion 56A) with respect to the spring receiving portion 21A1 between an engagement portion with respect to the hole 54D and an engagement portion with respect to the spring stopper portion 54E. Specifically, one end of the frame-side spring 56 passes through the hole 54D from the front face side toward the rear face side, and another end of the frame-side spring 56 is caught by the spring stopper portion 54E from the lower side toward the upper side. The catch portion 56A is formed at an intermediate portion of the frame-side spring 56 so as to be caught by the spring receiving portion 21A1 of the first abutment portion 21A. The frame-side spring 56 urges the spring receiving portion 21A1 as well as the first abutment portion 21A of the laser scanner 21 against the frame-side abutting portion 54 from the upper side toward the lower side to restrict movement of the laser scanner 21 in the up-and-down direction. For example, an operator inserts one end portion of the frame-side spring 56 into the hole 54D and allows the catch portion 56A to be caught by the spring receiving portion 21A1 of the laser scanner 21 from the upper side. Then, the operator pushes the frame-side spring 56 toward the lower side and allows another end portion of the frame-side spring 56 to be caught by the spring stopper portion 54E from the lower side to fix the laser scanner 21 to the first face 52A of the main frame 52.

The second abutment portion 21B also fixes the laser scanner 21 by urging the laser scanner 21 downward with a restoring force for elastic deformation of a stay-side spring 57 being a fixing member. As illustrated in FIG. 5, a hole 55A and a spring stopper portion 55B are provided in the vicinity of the stay-side abutting portion 55 of the scanner stay 50. A spring receiving portion 21B1 configured to catch the stay-side spring 57 is provided to the second abutment portion 21B of the laser scanner 21. The stay-side spring 57 is, for example, as illustrated in FIG. 5, a wire spring having an engagement portion (catch portion 57A) with respect to the spring receiving portion 21B1 between an engagement portion with respect to the hole 55A and an engagement portion with respect to the spring stopper portion 55B. Specifically, one end of the stay-side spring 57 passes through the hole 55A from the rear face side toward the front face side, and another end of the stay-side spring 57 is caught by the spring stopper portion 55B from the lower side toward the upper side. The catch portion 57A is formed at an intermediate portion of the stay-side spring 57 so as to be caught by the spring receiving portion 21B1 of the second abutment portion 21B. The stay-side spring 57 urges the spring receiving portion 21B1 as well as the second abutment portion 21B of the laser scanner 21 against the stay-side abutting portion 55 from the upper side toward the lower side to restrict the movement of the laser scanner 21 in the up-and-down direction. For example, an operator inserts one end portion of the stay-side spring 57 into the hole 55A and allows the catch portion 57A to be caught by the spring receiving portion 21B1 of the laser scanner 21 from the upper side. Then, the operator pushes the stay-side spring 57 toward the lower side and allows another end portion of the stay-side spring 57 to be caught by the spring stopper portion 55B from the lower side to fix the laser scanner 21 to the scanner stay 50.

The shapes of the frame-side springs 56 and the stay-side spring 57 are not limited to the modes illustrated in, for example, FIG. 4 and FIG. 5. Thus, a method for the engagement of the frame-side springs 56 and the main frame 52 and a method for the engagement of the frame-side springs 56 and the laser scanner 21 are also not limited to the modes illustrated in FIG. 4. Moreover, a method for the engagement of the stay-side spring 57 and the scanner stay 50 and a method for the engagement of the stay-side spring 57 and the laser scanner 21 are also not limited to the modes illustrated in FIG. 5. The fixing members are not limited to the springs and may be, for example, screws.

[Scanner Frame 51]

Now, a configuration of the scanner frame 51 relating to a characteristic portion of the first embodiment is described with reference to, for example, FIG. 3. The scanner frame 51 of the first embodiment includes a right frame 70 and a left frame 71 in addition to the mainframe 52 being the first frame and the subframe 53 being the second frame. The right frame 70 is provided on the right of the main frame 52 and the subframe 53. The left frame 71 is provided on the left of the main frame 52 and the subframe 53. That is, the scanner frame 51 has such a shape as to extend rightward and leftward to connect the right frame 70 and the left frame 71, which are arranged on the right and left of the main body of the printer 1, with the main frame 52 and the subframe 53.

As described later, the main frame 52 and the subframe 53 are connected to each other through caulking at a plurality of positions. At the right and left end portions of the scanner frame 51, the right frame 70 and the left frame 71 are fastened to one end and another end of each of the main frame 52 and the subframe 53 with fastening screws 75 (FIG. 8A and FIG. 8B). In such a manner, the scanner frame 51 is formed into a box shape, and the space Sp is located between the right frame 70 and the left frame 71. In the first embodiment, the right frame 70 and the left frame 71 are fixed to each of the first face 52A of the main frame 52, the second face 52B of the main frame 52, and the subframe 53. However, the right frame 70 and the left frame 71 may be fixed to at least two of: the first face 52A of the main frame 52, the second face 52B of the main frame 52, and the subframe 53.

Moreover, as illustrated in FIG. 3, the scanner stay 50 has such a shape as to extend rightward and leftward to connect the right frame 70 and the left frame 71, which are arranged on the right and left of the main body of the printer 1, to each other. At the right and left end portions of the scanner stay 50, screws 78 (FIG. 8A and FIG. 8B) are fastened to stay fastening portions 72 (not shown on the left side) via through holes formed in the right frame 70 and the left frame 71. In such a manner, one end portion of the scanner stay 50 in the longitudinal direction is fixed to the right frame 70, and another end portion of the scanner stay 50 in the longitudinal direction is fixed to the left frame 71. In particular, the screws 78 are provided at portions of the right frame 70 and the left frame 71 which overlap regions of end faces of a triangular prism formed of the main frame 52 and the subframe 53 in the longitudinal direction.

The sectional shape of the scanner stay 50 is also not limited to the shape given in the first embodiment and may be, for example, a quadrilateral shape, or an L-shape having an increased plate thickness. The scanner stay 50 of the first embodiment is not limited to the bent sheet metal, and may be formed of, for example, a resin having a rod shape as long as the rigidity can be secured so that the scanner stay 50 itself is less liable to be bent. Moreover, it is only required that the scanner stay 50 be capable of receiving the laser scanner 21 in a fixed manner and be fixed to the right frame 70 and the left frame 71, and the fixed portion 50A and the connection portion 50B may be omitted.

(Caulked Portion)

Figure 7:
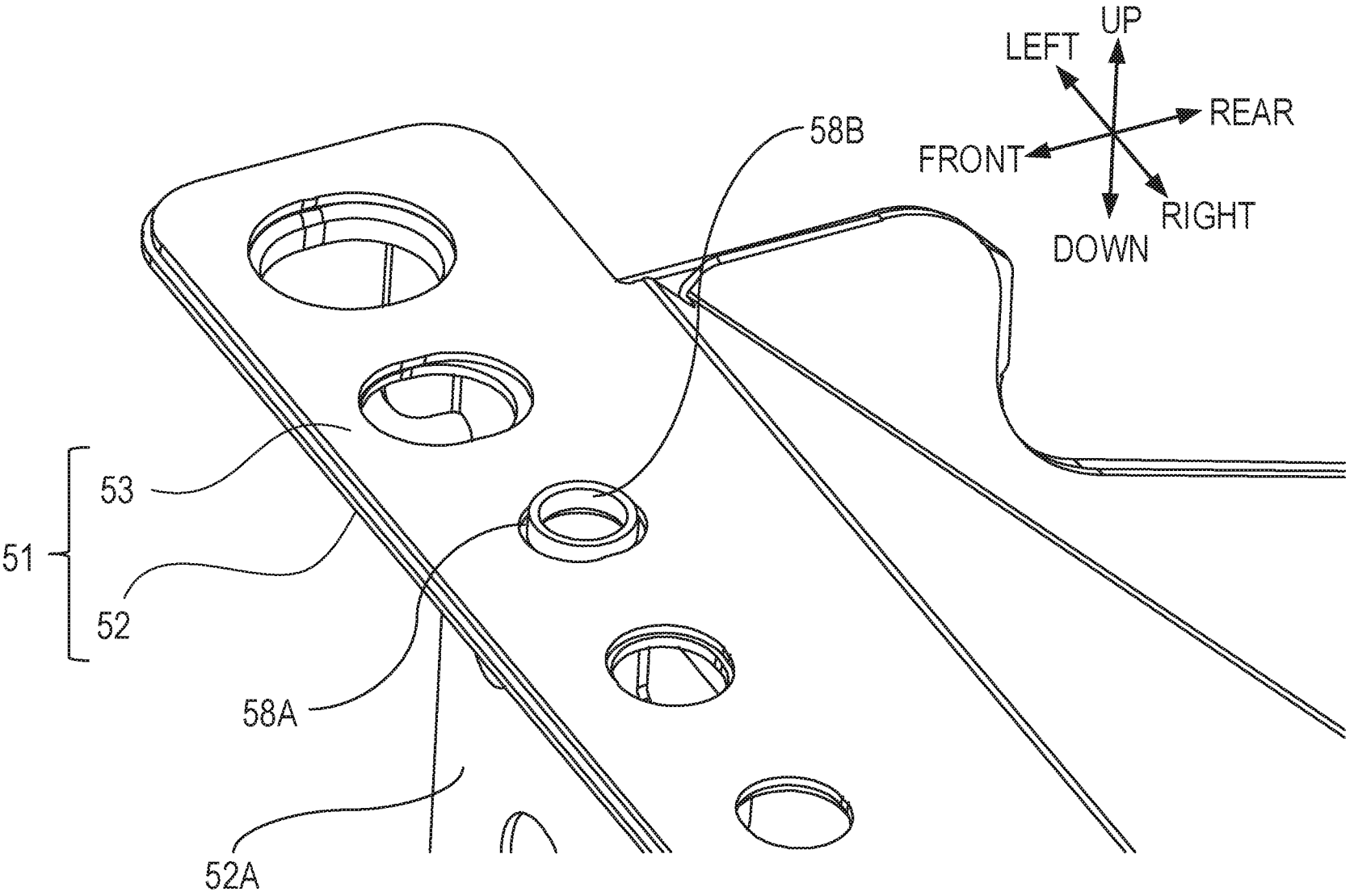
FIG. 7 is an enlarged view for illustrating a scanner-frame fastening portion of the first embodiment.

With reference to FIG. 7 which is an enlarged view for illustrating a part of the scanner frame 51, a configuration in which the main frame 52 and the subframe 53 are integrated with each other through caulking is described in detail. The scanner frame 51 includes a plurality of caulked portions 58, and the subframe 53 being a component on a fastened side is connected at the caulked portions 58 to the main frame 52 being a component on a fastening side.

The subframe 53 has a plurality of fastening holes 58A which are formed at predetermined intervals in the longitudinal direction (right-and-left direction) in one connection portion adjacently connected to the first face 52A of the main frame 52 and in another connection portion connected to the second face 52B of the main frame 52.

One connection portion of the main frame 52 includes caulking shafts 58B, which are provided at positions corresponding to the fastening holes 58A of the subframe 53 in the portion connected to one end of the subframe 53. Moreover, the connection portion of the second face 52B of the main frame 52 also includes caulking shafts 58B (FIG. 7) at positions corresponding to the fastening holes 58A of the subframe 53 in the portion connected to another end of the subframe 53. The caulking shafts 58B each have a cylindrical shape, which is obtained by forming a flange at a rim of the through hole through burring or the like and projects from the one connection portion of the main frame 52 adjacent to the first face 52A and the connection portion of the second face 52B.

The caulked portions 58 are arranged such that the caulking shafts 58B of the main frame 52 pass through the fastening holes 58A of the subframe 53. In such a manner, the one end and the another end of the subframe 53 are arranged so as to be laid on the connection portion of the main frame 52 connected adjacent to the first face 52A and on the connection portion of the second face 52B, respectively. The caulking shafts 58B are caulked to be plastically deformed so that the subframe 53 is sandwiched between the deformed portions of the caulking shafts 58B and the connection portion of the main frame 52 connected adjacent to the first face 52A and between the deformed portions of the caulking shafts 58B and the connection portion of the second face 52B. In such a manner, the subframe 53 is fixed at the caulked portions 58 to each of the connection portion of the main frame 52 connected adjacent to the first face 52A and the connection portion of the second face 52B. That is, the caulked portions 58 are each formed of the fastening hole 58A and the caulking shaft 58B and are provided at the connection portion of the main frame 52 connected adjacent to the first face 52A and the connection portion of the second face 52B.

All of the caulked portions 58 have substantially the same shape as the shape illustrated in FIG. 7. In the first embodiment, the main frame 52 and the subframe 53 are fastened to each other through burring caulking, but the method of fastening is not limited to the burring caulking and may be, for example, another caulking method, screw fastening, or welding.

(Effect)

In the first embodiment, the scanner frame 51 has such a box shape that the right frame 70 and the left frame 71 arranged on the right and left of the main body of the printer 1 are connected to each other by the main frame 52 and the subframe 53. That is, the main frame 52 and the subframe 53 have such a configuration that the sectional shape taken along the direction orthogonal to the longitudinal direction is the triangle. With this, the rigidity against twisting around the axis extending in the longitudinal direction can be improved. Moreover, the right frame 70 and the left frame 71 are provided at end portions of the main frame 52 and the subframe 53 in the longitudinal direction. With this, the rigidity against twisting around the axis extending in the longitudinal direction can be improved, and deformation of the first face 52A of the main frame 52, the second face 52B of the main frame 52, and the subframe 53, which correspond to the sides of the triangle in the cross section taken along the direction orthogonal to the longitudinal direction, in such a manner as to be bent toward the inner side or the outer side of the space Sp can be suppressed. Here, in the first embodiment, the scanner stay 50 is fixed to each of the right frame 70 and the left frame 71 to connect the right frame 70 and the left frame 71 to each other. With this configuration, even when the second face 52B of the main frame 52 is bent, displacement of the scanner stay 50 as well as the laser scanner 21 can be suppressed. Further, the screws 78 are provided at portions of the right frame 70 and the left frame 71 which overlap regions of end faces of a triangular prism formed of the main frame 52 and the subframe 53 in the longitudinal direction. With this configuration, the scanner stay 50 can be provided at portions of the right frame 70 and the left frame 71 which are less liable to be deformed when an external force is applied, thereby being capable of more effectively suppressing displacement of the scanner stay 50. With such a configuration that twisting of the scanner frame 51 and bending of the members forming the scanner frame 51 are suppressed, vibration that causes displacement of the laser scanner 21 in the sub-scanning direction is suppressed, thereby being capable of improving the vibration rigidity of the scanner frame 51.

In particular, in the first embodiment, a cutout or a hole shape is not formed at least in the end portions of the main frame 52 and the subframe 53 in the longitudinal direction, and the cross section that is taken along the direction orthogonal to the longitudinal direction and surrounds the space Sp has a shape of an uninterrupted and continuous annulus. That is, the scanner frame 51 has such a configuration that the right frame 70 and the left frame 71 are fixed to the end faces of the tubular body having the shape of the triangular annulus and being formed of the main frame 52 and the subframe 53. Specifically, in a cross section taken at a center portion of the scanner frame 51 in the longitudinal direction, the first face 52A of the main frame 52 has the opening 52C, and the subframe 53 has the opening 53A. As a result, the sectional shape is not a triangular annulus, and the side of the triangle is interrupted. However, such openings are not formed at least in the one end portion and the another end portion of the scanner frame 51, and the sectional shape is a triangular annulus with continuous sides. With this, the right frame 70 and the left frame 71 can be rigidly fixed to the main frame 52 and the subframe 53, thereby improving the rigidity against application of a sudden external force and deformation in the twisting direction. The scanner stay 50 is fixed to the scanner frame 51 having high rigidity, and hence propagation of vibration to the laser scanner 21 is suppressed, thereby being capable of suppressing image defects such as a blur and banding. The material of the right frame 70 and the left frame 71 is not limited to the sheet metal material and may be a resin material. Further, the right frame 70 and the left frame 71 may be integrated with the right side plate 73 and the left side plate 74. Moreover, as long as the rigidity of the scanner frame 51 can be secured, for example, the plate thickness of the subframe 53 may be set smaller than that of the main frame 52, or the main frame 52 and the subframe 53 may be integrated with each other, thereby being capable of reducing cost for materials and the number of components. Moreover, the scanner frame 51 may be formed with use of the three frames having the caulked portions 58 at both end portions as described with reference to FIG. 7. In this case, it is only required that the two frames be caulked at each of three corner portions of the triangle in the cross section of the scanner frame 51.

In the first embodiment, the scanner stay 50 and the second face 52B of the main frame 52 are in contact with each other, specifically, are fixed to each other. However, it is only required that the scanner stay 50 be fixed to the right frame 70 and the left frame 71 at least at the stay fastening portions 72 (FIG. 3) in the both end portions in the longitudinal direction, and it is not always required that the scanner stay 50 be in contact with the second face 52B of the main frame 52. With this, even when the second face 52B of the main frame 52 is bent, the scanner stay 50 is not affected.

As described above, according to the first embodiment, the vibration rigidity of the scanner unit can be improved with a simple configuration. In this case, the rigidity can be increased limitedly at parts that require high vibration rigidity. Therefore, an increase in unnecessary cost caused by excessive rigidity can be eliminated. Moreover, the twisting rigidity can be secured in a periphery of the scanner unit.

Therefore, a configuration which is highly resistant against plastic deformation caused by a shock given during transport can be achieved.

In the first embodiment, the right side plate 73 is mounted to the right frame 70, and the left side plate 74 is mounted to the left frame 71, thereby forming the frame of the main body of the printer 1. That is, members such as the photosensitive drum 22 are positioned and mounted on the right side plate 73 and the left side plate 74 with the laser scanner 21 as a reference point. Therefore, with the configuration in which the rigidity of the scanner frame 51 for the scanner unit is improved, the positioning accuracy of the members such as the photosensitive drum 22 with respect to the laser scanner 21 can be improved.

Modification Example of First Embodiment

The method of fixing the laser scanner 21 is not limited to the configuration described in the first embodiment. In view of this, in the following, a modification example of the support configuration for the laser scanner 21 is described. In this modification example, after description is made of a configuration of the laser scanner 21 which is not described in detail in the first embodiment, the support configuration for the laser scanner 21 is described.

[Configuration of Laser Scanner]

Figure 9A:
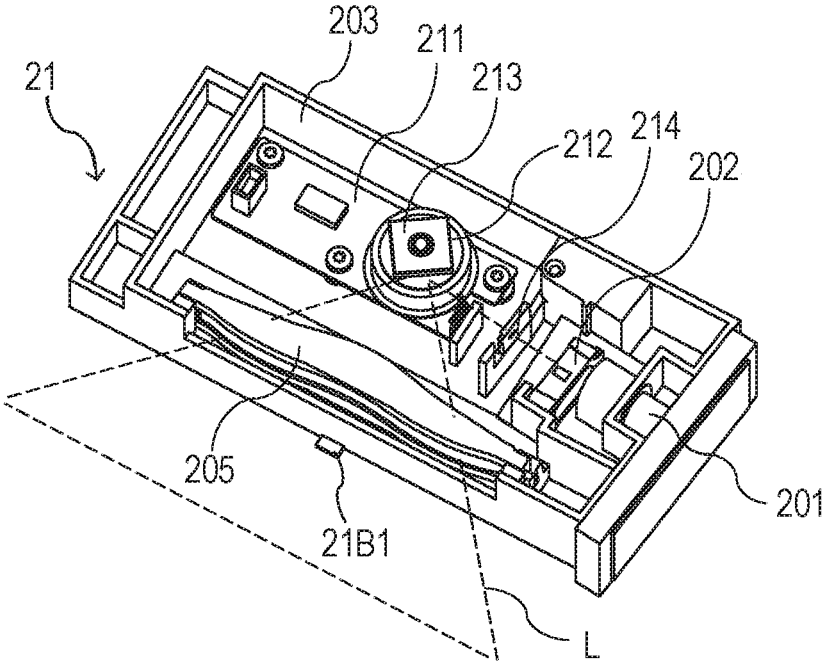
FIGS. 9A and 9B are perspective views for illustrating the laser scanner in a modification example of the first embodiment.
Figure 9B:
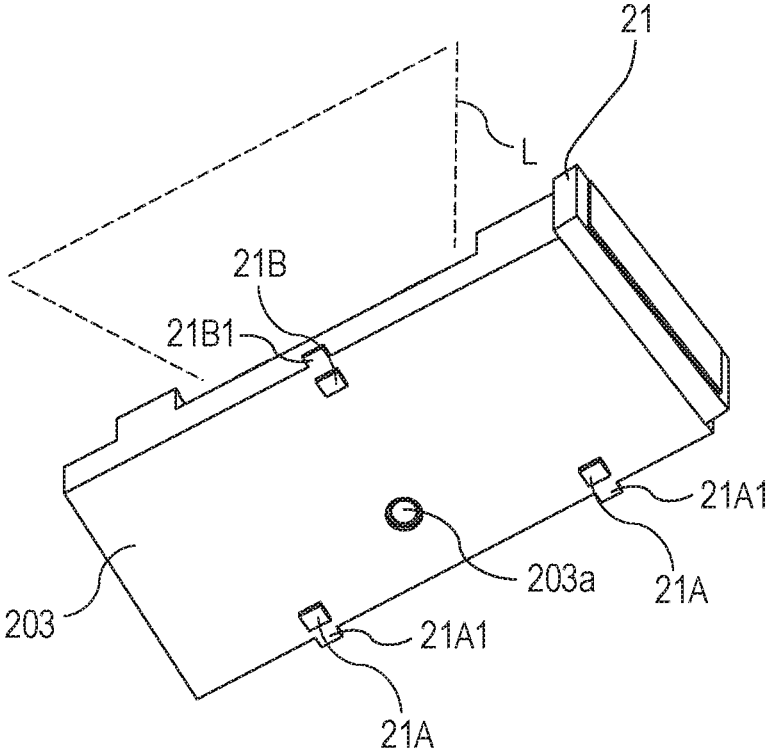

FIG. 9A is a top perspective view for illustrating the laser scanner 21, which is a scanning optical device, as seen from an upper face side. FIG. 9B is a bottom perspective view for illustrating the laser scanner 21 as seen from a bottom face side. In FIG. 9A, for description of an internal configuration, illustration is given of a state in which a cover configured to cover an opening portion of the laser scanner 21 is removed. When the laser scanner 21 is installed on the printer 1, the opening portion of the laser scanner 21 is covered with an optical cover (not shown) made of a resin or metal so that the inside of the laser scanner 21 is brought into a tightly closed state.

A light deflector 211 configured to deflect a laser beam and various optical members are arranged inside a housing 203 of the laser scanner 21. The light deflector 211 includes, for example, a rotary polygon mirror 213, a scanner motor 212, and a control IC. The rotary polygon mirror 213 is configured to deflect an optical path of an entering laser beam. The scanner motor 212 is configured to drive the rotary polygon mirror 213 to rotate. The control IC is configured to control the rotation of the scanner motor 212. A resonant optical scanning element such as so-called MEMS may be used as the light deflector 211 configured to deflect a laser beam L. Moreover, the housing 203 of this modification example is made of a resin. In the following description, a direction in which the laser beam L deflected and scanned by the light deflector 211 scans the surface of the photosensitive drum 22 (also the rotation axis direction of the photosensitive drum 22) is referred to as "main scanning direction", and a direction perpendicular to the main scanning direction (also the rotation direction of the photosensitive drum 22) is referred to as "sub-scanning direction".

The laser beam L emitted from a laser diode 201 being a light source in accordance with image information is formed into substantially parallel light or convergent light in the main scanning direction and into convergent light in the sub-scanning direction by a composite anamorphic collimator lens 202. Then, the laser beam L having passed through the composite anamorphic collimator lens 202 is formed into a laser beam having a predetermined beam diameter limited by an optical diaphragm 204 formed in the housing 203. The laser beam L having passed through the optical diaphragm 204 proceeds to the rotary polygon mirror 213 driven by the scanner motor 212 and is reflected on a reflection surface of the rotary polygon mirror 213 to be deflected. The laser beam L having been deflected proceeds to an fθ lens 205. After passing through the fθ lens 205, the laser beam L is condensed on the photosensitive drum 22 from an opening portion (emission slot), which is formed in the housing 203 and allows the laser beam L to pass therethrough. As a result, an electrostatic latent image is formed on the photosensitive drum 22. Moreover, in FIG. 9A, the broken lines indicate a range in the main scanning direction in which the laser beam L having been deflected by the rotary polygon mirror 213 is emitted.

Next, the two first abutment portions 21A and the second abutment portion 21B, which are mounting reference surfaces, are described. FIG. 9B is a perspective view for illustrating a bottom face of the laser scanner 21. In FIG. 9B, the upper left side corresponds to the bottom face on the side of the face of the housing 203 in which the opening portion (emission slot) through which the laser beam is emitted is formed, and the lower right side corresponds to the bottom face on the side of the face of the housing 203 on which the light deflector 211 is installed. On the bottom face of the laser scanner 21, three abutment portions in total, specifically, two first abutment portions 21A and one second abutment portion 21B are provided. The mounting reference surfaces correspond to seat surfaces which are brought into abutment against the scanner stay 50 and the main frame 52 when the laser scanner 21 is supported by the scanner stay 50 and the main frame 52. In this modification example, the mounting reference surface has a square shape of about 5 mm×5 mm and has a smooth flat surface. Moreover, in this modification example, the second abutment portion 21B is provided in the vicinity of the center portion at the end portion of the housing 203 of the laser scanner 21 on the side of the emission slot for the laser beam L. The two first abutment portions 21A are provided in the vicinity of the end portion of the housing 203 on the side opposite to the side of the emission slot for the laser beam of the laser scanner 21 where the light deflector 211 is installed, and are arranged at positions apart by equal distances in the main scanning direction (longitudinal direction in FIG. 9B) across a position opposed to the second abutment portion 21B. In this modification example, one mounting reference surface is provided on the side of the emission slot for the laser beam L on the bottom face of the housing 203, and two mounting reference surfaces are provided on the side on which the light deflector 211 is installed. However, two mounting reference surfaces may be provided on the side of the emission slot for the laser beam L, and one mounting reference surface may be provided on the side on which the light deflector 211 is installed.

Moreover, as described later, the two first abutment portions 21A and the second abutment portion 21B are parallel to one another when being brought into abutment against the scanner stay 50 and the main frame 52. That is, the housing 203 of the laser scanner 21 is inclined at a predetermined angle of elevation so that the laser beam L is directed to the photosensitive drum 22, and the two first abutment portions 21A and the second abutment portion 21B are formed as inclined surfaces having the same angle with respect to the bottom face of the housing 203. Further, on outer sides of an outer periphery of the housing 203 at positions corresponding to the two first abutment portions 21A and the second abutment portion 21B in the longitudinal direction of the housing 203 (also the main scanning direction), there are provided the two spring receiving portions 21A1 and the spring receiving portion 21B1 each having such a shape as to protrude from the housing 203. As described later, the two spring receiving portions 21A1 and the spring receiving portion 21B1 are provided to urge the laser scanner 21 against the scanner stay 50 and the main frame 52 with use of the stay-side spring 57 and the frame-side spring 56 (see FIG. 10 and FIG. 11B). A hole 203*a* illustrated in FIG. 9B is a boss hole for supporting a rotation shaft of the scanner motor 212 of the light deflector 211.

[Configuration for Supporting Laser Scanner]

Figure 10:
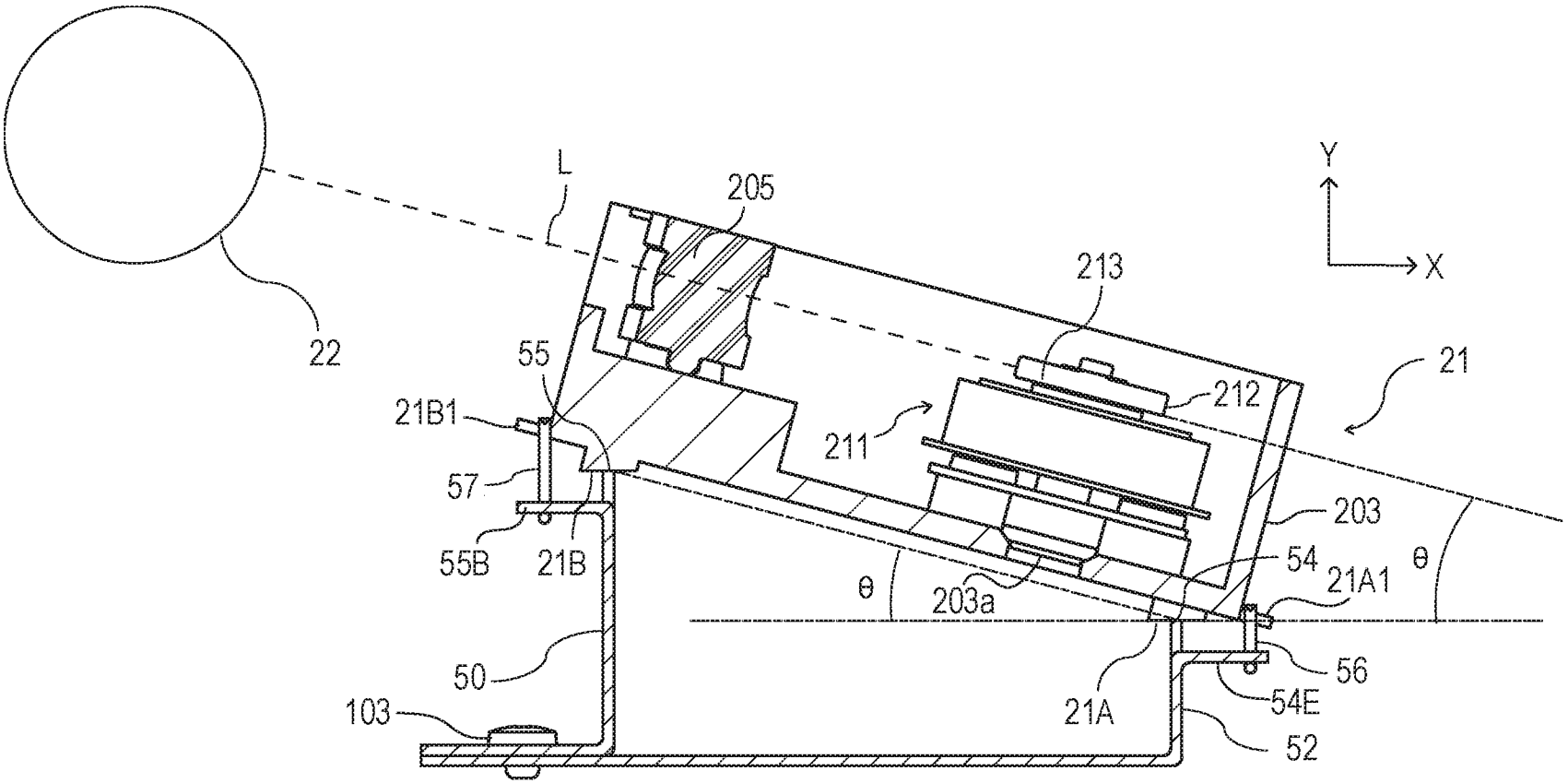
FIG. 10 is a sectional view for illustrating peripheral components provided around the laser scanner in the modification example of the first embodiment.

Next, a method of supporting the laser scanner 21 with use of the scanner stay 50 and the main frame 52 in this modification example is described. FIG. 10 is an explanatory schematic sectional view for illustrating configurations of the scanner stay 50 and the main frame 52 for supporting the laser scanner 21 in the printer 1, and is a sectional view taken along a center of the rotation shaft of the scanner motor 212 of the light deflector 211 of the laser scanner 21. In FIG. 10, illustration of the main frame 52 at a position higher than the laser scanner 21 is omitted. Moreover, in FIG. 10, the X axis corresponds to a horizontal direction, and the Y axis corresponds to a vertical direction.

FIG. 10 is a sectional view for illustrating a state in which the laser scanner 21 is supported by the scanner stay 50 and the main frame 52. Specifically, in FIG. 10, the second abutment portion 21B provided on the bottom face of the housing 203 of the laser scanner 21 is brought into abutment against the stay-side abutting portion 55 of the scanner stay 50, and the two first abutment portions 21A are brought into abutment against corresponding ones of the frame-side abutting portions 54 of the main frame 52, thereby allowing the laser scanner 21 to be supported by the scanner stay 50 and the main frame 52. The stay-side abutting portion 55 corresponds to an abutting surface provided at the end portion that is brought into abutment against the second abutment portion 21B of the scanner stay 50. Similarly, the frame-side abutting portions 54 are abutting surfaces provided at the end portion that is brought into abutment against the two first abutment portions 21A of the main frame 52. Moreover, in FIG. 10, one of the first abutment portions 21A is not shown. The broken line indicates an optical path on which the laser beam L, which has been emitted from the laser diode 201 (not shown in FIG. 10) and deflected by the rotary polygon mirror 213 driven by the scanner motor 212 of the light deflector 211, scans the surface of the photosensitive drum 22.

In this modification example, a position of the stay-side abutting portion 55 of the scanner stay 50, against which the second abutment portion 21B of the laser scanner 21 is brought into abutment, from the bottom face inside the printer 1 is higher than positions of the frame-side abutting portions 54 of the main frame 52, against which the first abutment portions 21A are brought into abutment. Therefore, the laser scanner 21 is installed on the scanner stay 50 and the main frame 52 at an angle θ, which is an angle of elevation from the horizontal direction (X-axis direction of FIG. 10), with respect to the photosensitive drum 22. As illustrated in FIG. 10, the angle θ is an angle of the rotary polygon mirror 213 (or the bottom face of the housing 203 of the laser scanner 21), which is orthogonal to the rotation shaft of the scanner motor 212 of the light deflector 211, with respect to the horizontal direction. The flat surfaces (reference surfaces) of the two first abutment portions 21A and the second abutment portion 21B, which are brought into abutment against the stay-side abutting portion 55 of the scanner stay 50 and the frame-side abutting portions 54 of the main frame 52, are also formed so as to have the angle θ with respect to the bottom face of the housing 203 of the laser scanner 21. Further, the positions of the frame-side abutting portions 54 and the stay-side abutting portion 55 are set such that an angle of a line segment connecting the frame-side abutting portions 54 of the main frame 52 and the stay-side abutting portion 55 of the scanner stay 50 to each other with respect to the horizontal direction is set to the angle θ. Therefore, the entire surfaces of the first abutment portions 21A and the second abutment portion 21B are parallel to the frame-side abutting portions 54 of the main frame 52 and the stay-side abutting portion 55 of the scanner stay 50. As a result, when the first abutment portions 21A and the second abutment portion 21B are brought into abutment against the frame-side abutting portions 54 of the main frame 52 and the stay-side abutting portion 55 of the scanner stay 50, the all mounting reference surfaces are brought into abutment (surface contact). In FIG. 10, one of the first abutment portions 21A is not shown, but is brought into abutment against the frame-side abutting portion 54 (not shown) of the main frame 52 with the same configuration as the first abutment portion 21A illustrated in FIG. 10.

Moreover, the stay-side spring 57 extends so as to pass the upper side in FIG. 10 of the spring receiving portion 21B1 provided to the housing 203 of the laser scanner 21 and the lower side in FIG. 10 of the spring stopper portion 55B provided to the scanner stay 50. The frame-side spring 56 extends so as to pass the upper side in FIG. 10 of the spring receiving portion 21A1 provided to the housing 203 of the laser scanner 21 and the lower side in FIG. 10 of the spring stopper portion 54E provided to the main frame 52 at the middle. With the stay-side spring 57 and the frame-side spring 56 arranged in such a manner, the laser scanner 21 is urged toward the scanner stay 50 and the main frame 52.

[Configuration of Main Body Frame]

Figure 11A:
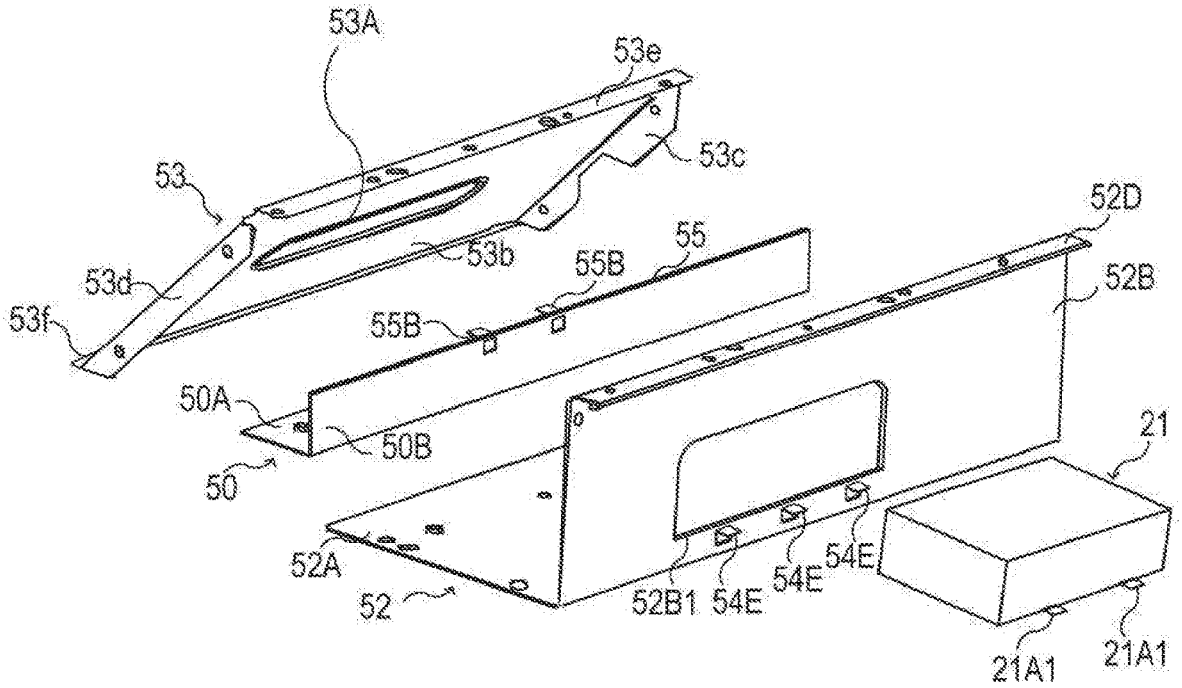
FIG. 11A is an exploded perspective view for illustrating the peripheral components provided around the laser scanner in the modification example of the first embodiment.

Here, configurations of the scanner stay 50 and the main frame 52 illustrated in FIG. 10 and a method of supporting the laser scanner 21 with wire springs are described. FIG. 11A is a perspective view for illustrating the main frame 52 and the subframe 53, which are members forming the scanner frame 51, as well as the scanner stay 50 mounted to the scanner frame 51 under a state in which the members are disassembled.

The subframe 53 includes a face 53*b*, as a center, and four faces 53*c*, 53*d*, 53*e*, and 53*f* which are adjacent to the face 53*b*. The face 53*b* has the opening 53A at a center portion thereof to allow the laser beam emitted from the laser scanner 21 to pass therethrough. The faces 53*c* and 53*d* provided on both sides of the face 53*b* in the right-and-left direction of FIG. 11A are provided for connection to side plate frames (not shown) provided on side faces of the printer 1. Circular holes formed in each of the faces 53*c* and 53*d* are screw holes for connection to the side plate frames. Screw holes for connection to a face 52D of the main frame 52 are formed in the face 53*e* adjacent to the face 53*b* on the upper side of FIG. 11A. The face 53*f* adjacent to the face 53*b* has screw holes (not shown) for fixing the subframe 53 to the bottom face of the housing of the printer 1. Through fixing of the face 53*f* to the printer 1, the scanner frame 51 is fixed to the printer 1, thereby improving the rigidity of the scanner frame 51.

The scanner stay 50 is formed by bending one piece of sheet metal into an L-shape. The scanner stay 50 includes the fixed portion 50A (first face) and the connection portion 50B (second face) that is bent so as to be perpendicular to the fixed portion 50A or extend in the vertical direction. The fixed portion 50A has holes for connecting the scanner stay 50 to the main frame 52 with a screw 103 (see FIG. 10). FIG. 10 is an illustration of a state in which the scanner stay 50 is screwed to the main frame 52. The connection portion 50B includes the stay-side abutting portion 55 (supporting seat surface), against which the second abutment portion 21B of the housing 203 of the laser scanner 21 is brought into abutment, and the two spring stopper portions 55B, which have such a shape as to project from the connection portion 50B and are configured to urge the spring receiving portions 21A1 of the housing 203 with the stay-side spring 57. The two spring stopper portions 55B are formed by cutting out parts in the vicinity of the stay-side abutting portion 55 of the connection portion 50B at positions apart from each other by an equal distance with the spring receiving portions 21A1 of the housing 203 as centers and bending the cut-out parts so as to be perpendicular to the connection portion 50B.

The main frame 52 is formed by subjecting one piece of sheet metal to a bending process of bending the sheet metal into an L-shape and a process of forming the opening portion. The main frame 52 includes the first face 52A (third face), the second face 52B (fourth face) that is bent so as to be perpendicular to the first face 52A or extend in the vertical direction, and the face 52D that is bent so as to be perpendicular to the second face 52B. The face 52D is, as mentioned above, the face that is formed for connection to the face 53*e* of the subframe 53, and has the screw holes for screwing the face 52D to the face 53*e* of the subframe 53. Moreover, the first face 52A has, in addition to the screw holes for connection to the scanner stay 50, screw holes for fixing the main frame 52 to the bottom face of the housing of the printer 1. The second face 52B has an opening portion which serves as an inlet and an outlet for the laser scanner 21 at the time of mounting and removing the laser scanner 21. Moreover, the rim portion 52B1 of the opening portion is a flat surface (supporting seat surface) against which the two first abutment portions 21A of the housing 203 of the laser scanner 21 are brought into abutment.

Moreover, the three spring stopper portions 54E each having such a shape as to project from the second face 52B are provided in the vicinity of the rim portion 52B1 of the opening portion to urge the spring receiving portions 21A1 of the housing 203 with the frame-side spring 56. The three spring stopper portions 54E are formed by cutting out parts in the vicinity of the rim portion 52B1 of the second face 52B at such a position that each spring receiving portions 21A1 of the housing 203 is located at the center of the adjacent spring stopper portions 54E and bending the cut-out parts so as to be perpendicular to the second face 52B. The laser scanner 21 of FIG. 11A is illustrated in a perspective view as seen from the side opposite to the side on which the opening portion through which the laser beam L is emitted is formed, and it can be seen that the two spring receiving portions 21A1 of the first abutment portions 21A urged with the frame-side spring 56 are provided on the side of the end portion on the outer periphery of the housing 203.

[Urging Scanning Optical Device with Wire Spring]

Figure 11B:
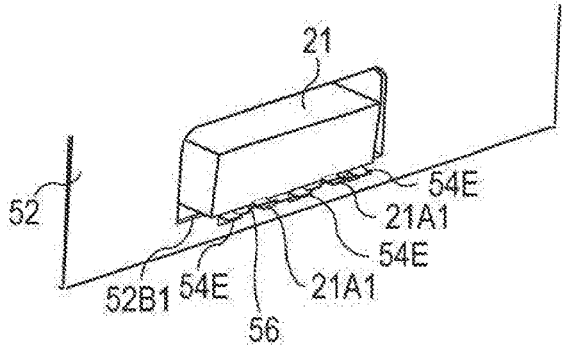
FIG. 11B is a perspective view for illustrating a state in which the laser scanner in the modification example of the first embodiment is installed on a main frame.

FIG. 11B is a perspective view for illustrating a state in which the two first abutment portions 21A of the housing 203 of the laser scanner 21 are installed on the rim portion 52B1 of the main frame 52. In FIG. 11B, the two spring receiving portions 21A1 provided to the housing 203 of the laser scanner 21 and the three spring stopper portions 54E provided to the main frame 52 are urged with the frame-side spring 56. Specifically, the frame-side spring 56 is installed as follows. That is, with respect to the three spring stopper portions 54E provided to the main frame 52, the frame-side spring 56 is installed in such a manner as to come into contact with back surfaces of claw portions (surfaces facing the lower side of FIG. 11B). With respect to the two spring receiving portions 21A1 provided to the housing 203 of the laser scanner 21, the frame-side spring 56 is installed in such a manner as to come into contact with front surfaces of claw portions (surfaces facing the upper side of FIG. 11B). Further, the frame-side spring 56 is bent into a crank shape in accordance with height differences of adjacent claw portions between the claw portions provided to the housing 203 of the laser scanner 21 and the claw portions provided to the main frame 52. Although illustration is not given in FIG. 11B, in the same method as the above-mentioned method, the spring receiving portion 21B1 provided to the housing 203 of the laser scanner 21 and the two spring stopper portions 55B provided to the scanner stay 50 are urged with the stay-side spring 57. Further, in order to allow the laser scanner 21 to be mounted and removed, the stay-side spring 57 and the frame-side spring 56 are installed in such a manner as to be mountable and removable.

As described above, in this modification example, the laser scanner 21 is supported by the stay-side abutting portion 55 of the scanner stay 50 and the rim portion 52B1 of the main frame 52 through intermediation of the two first abutment portions 21A and the second abutment portion 21B. The vibration of the laser scanner 21 caused by the scanner motor 212 of the light deflector 211 is less liable to be transmitted in the direction perpendicular to the flat surfaces of the scanner stay 50 and the main frame 52. Therefore, bending of the connection portions 50B and 52B (see FIG. 11A), which extend in the vertical direction (Y-axis direction of FIG. 10), of the scanner stay 50 and the main frame 52 can be alleviated. As a result, the vibration of the laser scanner 21 in the sub-scanning direction (Y-axis direction of FIG. 10) can be alleviated without adding a reinforcing member. Further, degradation in image quality, such as pitch unevenness, caused by periodical shifting of the irradiation position of the laser beam L, which is emitted from the laser scanner 21, on the photosensitive drum 22 in the sub-scanning direction (rotation direction of the photosensitive drum 22) can be suppressed.

Moreover, as illustrated in FIG. 10, in order to radiate the laser beam L, which is emitted from the laser scanner 21, obliquely from the lower side with respect to the photosensitive drum 22, the position of the stay-side abutting portion 55 of the scanner stay 50 in the vertical direction (Y-axis direction) is set higher than the position of the rim portion 52B1 of the main frame 52 in the vertical direction. Therefore, the laser scanner 21 can be arranged in such a manner as to be inclined toward the upper side of FIG. 10 with respect to the horizontal direction (X-axis direction). Further, an angle formed between each of the two first abutment portions 21A and the second abutment portion 21B and the direction perpendicular to the rotation shaft of the scanner motor 212 and an angle formed between the line segment connecting the stay-side abutting portion 55 of the scanner stay 50 and the rim portion 52B1 of the main frame 52 to each other and the horizontal direction (X-axis direction) are the same angle θ. Therefore, when the laser scanner 21 is installed, the two first abutment portions 21A, the second abutment portion 21B, the stay-side abutting portion 55, and the rim portion 52A1 are substantially parallel to one another. Therefore, the two first abutment portions 21A and the second abutment portion 21B are brought into the state of surface contact with the stay-side abutting portion 55 and the rim portion 52B1, thereby being capable of stably installing the laser scanner 21. In particular, in this modification example, as illustrated in FIG. 11A, the connection portions 50B of the scanner stay 50 are bent so as to be perpendicular to the fixed portion 50A. Similarly, the second face 52B of the main frame 52 is bent so as to be perpendicular to the first face 52A. As a result, the two first abutment portions 21A and the second abutment portion 21B, which are provided to the housing 203 of the scanning optical device, are brought into a state of surface contact in a horizontal plane with the stay-side abutting portion 55 of the scanner stay 50 and the rim portion 52B1 of the main frame 52. Therefore, the connection portion 50B of the scanner stay 50, which includes the stay-side abutting portion 55, and the second face 52B of the main frame 52, which includes the rim portion 52B1, can receive the load of the laser scanner 21 in the substantially vertical direction, thereby being capable of more stably installing the laser scanner 21.

Further, the two first abutment portions 21A and the second abutment portion 21B, which are provided to the housing 203 of the laser scanner 21, come into surface contact with the stay-side abutting portion 55 of the scanner stay 50 and the rim portion 52B1 of the main frame 52. Thus, the two first abutment portions 21A and the second abutment portion 21B are prevented from being brought into contact with corner portions of the stay-side abutting portion 55 of the scanner stay 50 and corner portions of the rim portion 52B1 of the main frame 52. Therefore, the two first abutment portions 21A and the second abutment portion 21B are prevented from being shaved through contact with the corner portions of the stay-side abutting portion 55 and the corner portions of the rim portion 52B1. With this, scattering of dust shaved off from the two first abutment portions 21A and the second abutment portion 21B into the printer 1 is suppressed, and hence degradation in support accuracy for the laser scanner 21 caused by the two first abutment portions 21A and the second abutment portion 21B shaved off can be suppressed.

Moreover, in this modification example, the laser scanner 21 itself is inclined so that an angle is given to the laser beam L radiated to the photosensitive drum 22. With this, there is no need to install separate members such as a reflection mirror inside the laser scanner 21 to give an emission angle to the laser beam L emitted from the laser scanner 21. As a result, a space for arranging the reflection mirror and the like in the laser scanner 21 can be reduced, thereby being capable of achieving downsizing and cost reduction of the laser scanner 21.

Further, in this modification example, the laser scanner 21 is installed in an inclined state so that the laser beam L can be radiated obliquely from the lower side with respect to the photosensitive drum 22. Therefore, the installation position of the laser scanner 21 can be arranged at a position lower than the position given in the case of radiating the laser beam L to the photosensitive drum 22 in the horizontal direction. With this, the height of the printer 1 can be set lower, for example, as the installation position of the laser scanner 21 is set lower. Further, through the installation of the laser scanner 21 in the inclined state, the length of the printer 1 in the horizontal direction can also be suppressed, thereby being capable of further downsizing the printer 1.

Further, as described above, the two first abutment portions 21A and the second abutment portion 21B, which are provided to the housing 203 of the scanning optical device, are supported by the stay-side abutting portion 55 of the scanner stay 50 and the rim portion 52B1 of the main frame 52. In this modification example, both end portions of the scanner stay 50 and the main frame 52 in the longitudinal direction (main scanning direction) are in contact with the side plate frames (not shown) provided inside the printer 1. Therefore, even when the laser scanner 21 is downsized, and the length of the housing 203 in the longitudinal direction is reduced, the laser scanner 21 can be supported by the stay-side abutting portion 55 and the rim portion 52B1 of the scanner stay 50 and the main frame 52. Therefore, no additional supporting member is required, thereby being capable of suppressing an increase in cost of the printer 1. As a result, the degree of freedom in arrangement of the laser scanner 21 in the printer 1 is improved, thereby being capable of providing the printer 1 that is downsized and reduced in cost.

As described above, according to this modification example, the scanning optical device can be stably supported with the sheet metal frame.

Second Embodiment

Figure 12:
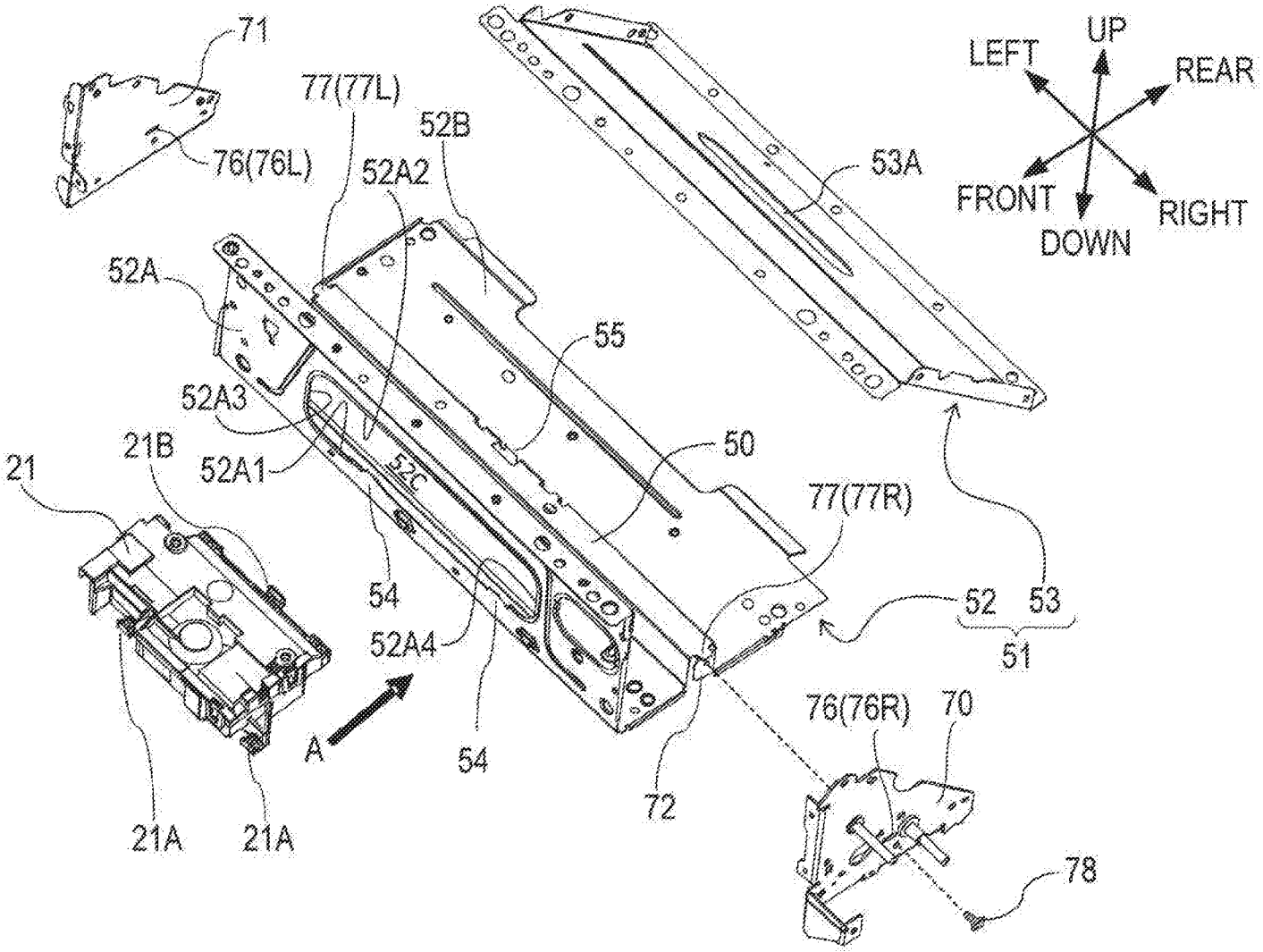
FIG. 12 is an exploded perspective view for illustrating peripheral components provided around a laser scanner of the second embodiment.
Figure 13:
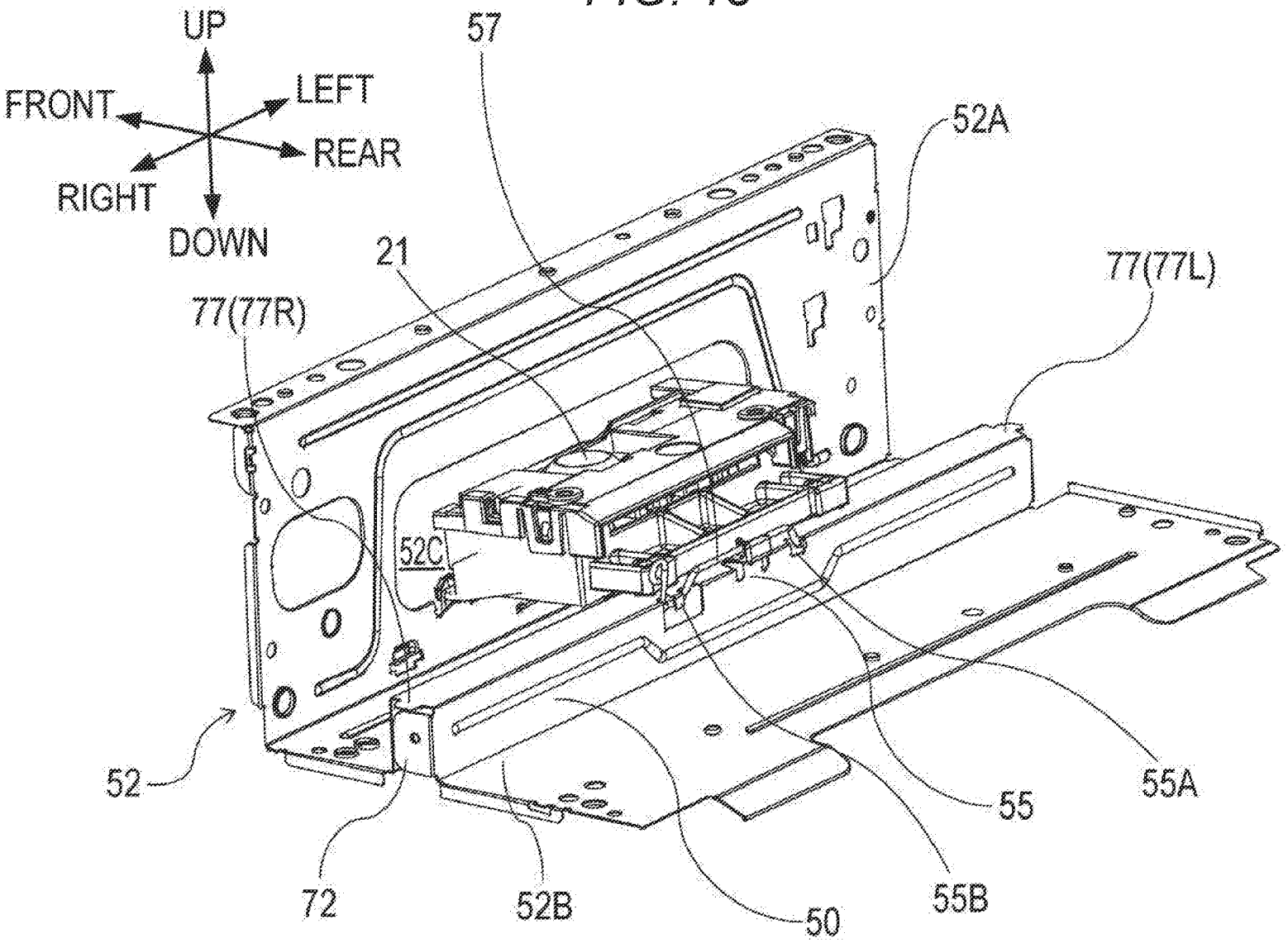
FIG. 13 is a rear perspective view for illustrating a mounting portion for the laser scanner of the second embodiment.
Figure 14:
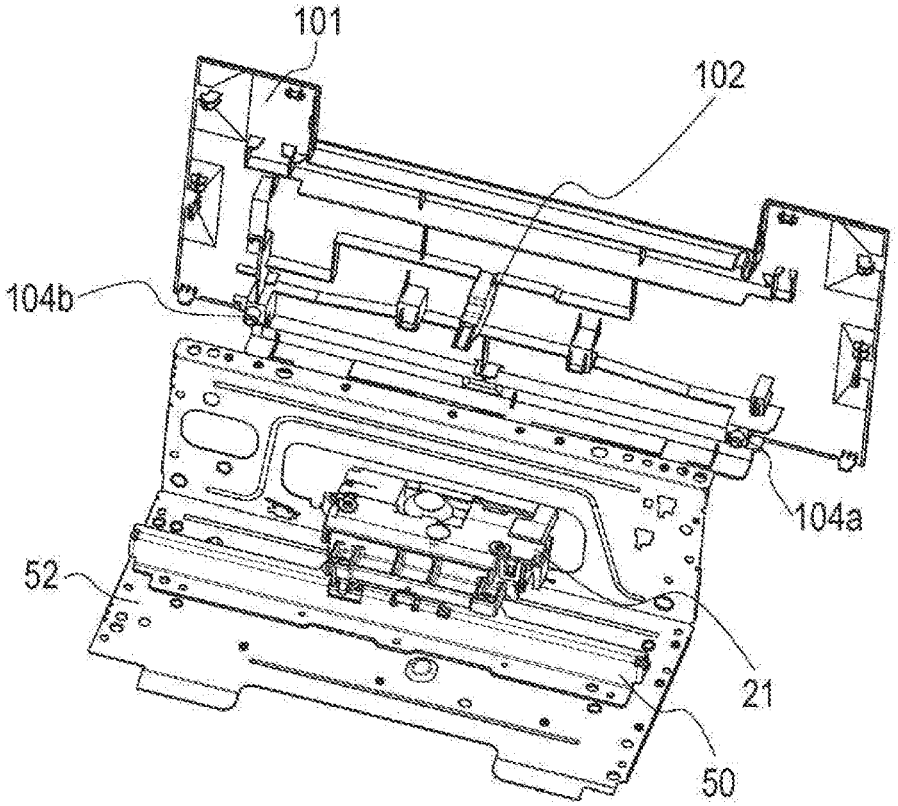
FIG. 14 is an exterior perspective view for illustrating an exterior cover and a main frame in another modification example.
Figure 15:
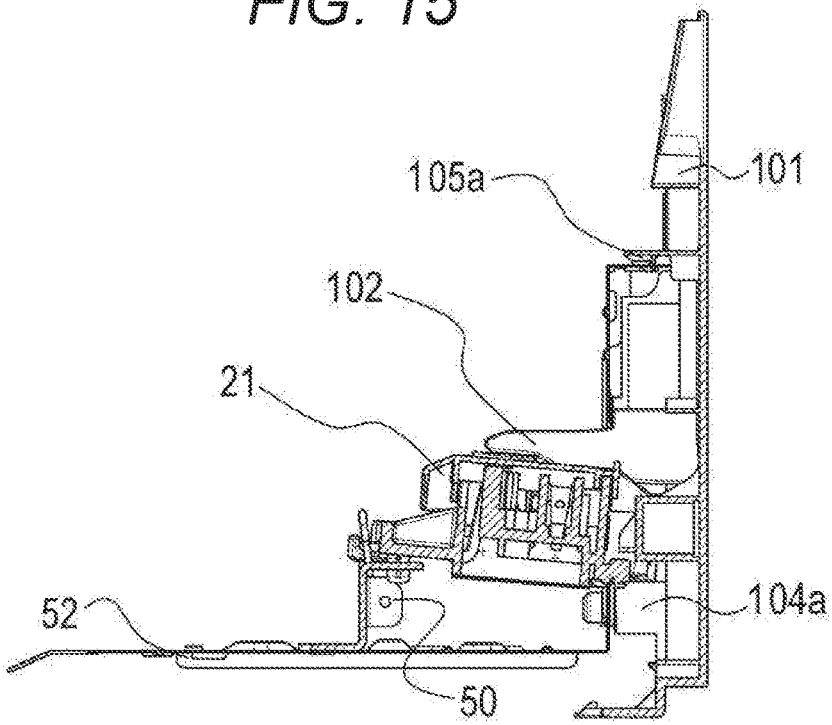
FIG. 15 is a left-side sectional view for illustrating a positional relationship between the exterior cover and the main frame in the another modification example.

FIG. 12 is an exploded view for illustrating peripheral components provided around the laser scanner 21 of a second embodiment. FIG. 13 is a rear enlarged view for illustrating a mounting portion for the laser scanner 21 of the second embodiment. With reference to FIG. 12 and FIG. 13, the second embodiment having a different support configuration for the laser scanner 21 is described. The main change from the first embodiment is that the scanner stay 50 is integrated with the main frame 52. That is, the scanner stay 50 is formed by a part of the scanner frame 51. In the description of the second embodiment, the change from the first embodiment is described. Other configurations are the same as those of the first embodiment, and hence description is omitted.

In the second embodiment, the stay-side abutting portion 55 and the stay fastening portions 72 are formed on the second face 52B of the main frame 52. Moreover, the hole 55A and the spring stopper portion 55B are also provided to the second face 52B of the main frame 52. In the second embodiment, the number of components can be further reduced, thereby being capable of achieving a simpler configuration. The shape of the part corresponding to the scanner stay 50 is set such that a sectional shape orthogonal to the longitudinal direction is a substantially U-shape with an open lower side. Further, at both right and left end portions, which are both end portions in the longitudinal direction, of the part corresponding to the scanner stay 50, there are provided protruded portions 77 projecting outward. The right frame 70 and the left frame 71 have openings 76, respectively, at positions corresponding to the protruded portions 77.

Specifically, the scanner stay 50 includes a protruded portion 77R and a protruded portion 77L. The protruded portion 77R is a first protruded portion provided at one end portion in the longitudinal direction. The protruded portion 77L is a second protruded portion provided at another end portion in the longitudinal direction. Moreover, the right frame 70 has an opening 76R into which the protruded portion 77R is inserted, and the left frame 71 has an opening 76L into which the protruded portion 77L is inserted.

At the time of fixing the right frame 70 and the left frame 71 to the scanner frame 51, screws can be fastened under a state in which the right frame 70 and the left frame 71 are positioned through insertion of the protruded portions 77, which are provided on both right and left end portions, into the openings 76 formed in the right frame 70 and the left frame 71. Through such positioning, the rigidity of the scanner frame 51 is secured.

The configuration including the protruded portions 77 may be applied to the configuration of the first embodiment in which the scanner stay 50 which is separate from the second face 52B of the main frame 52 is provided. In this case, the right frame 70 and the left frame 71 of the first embodiment have the openings 76 into which the protruded portions 77 are inserted. With this, also in the first embodiment, the scanner stay 50 can be easily positioned with respect to the right frame 70 and the left frame 71, thereby being capable of improving the rigidity of the scanner frame 51. Moreover, in the case of the configuration in which the separate scanner stay 50 is not brought into contact with the second face 52B of the main frame 52, both end portions of the scanner stay 50 can be easily positioned with respect to the right frame 70 and the left frame 71.

As described above, according to the second embodiment, the vibration rigidity of the scanner unit can be improved with a simple configuration.

OTHER EMBODIMENTS

The embodiments described above are each one embodiment of the image forming apparatus according to the present disclosure, and are not limited to the above-mentioned modes.

For example, in the above-mentioned embodiments, it is supposed that the scanner stay 50 is the sheet metal material. However, as long as the required rigidity is satisfied, a resin material may be used. For example, in the above-mentioned embodiments, the laser scanner 21 is fixed through urging with the springs. However, the laser scanner 21 may be fixed through use of other fixing members such as screws. For example, in the above-mentioned embodiments, the scanner frame 51 has a sectional shape of a substantially triangle. However, as long as a shape that does not impair the second moment of area, the sectional shape may be a circle, an oval, or any other polygonal shape.

For example, in the above-mentioned embodiments, the monochrome printer 1 including one photosensitive drum 22 is described. However, the present disclosure is not limited to this mode, and may also be applied to a color image forming apparatus of, for example, a tandem type including a plurality of photosensitive drums 22. Moreover, the present disclosure is applicable also to an image forming apparatus that uses a transfer material carrying belt configured to carry and convey a transfer material.

As described above, also in other embodiments, the vibration rigidity of the scanner unit can be improved with a simple configuration.

Other Modification Example

Further, there may be provided a configuration in which the movement of the laser scanner 21 can be restricted with an exterior cover of the printer 1. For example, there may be provided a configuration of this modification example in which a pressing portion is provided to the exterior cover of the image forming apparatus.

As illustrated in FIG. 14, FIG. 15, FIG. 16A, and FIG. 16B, a pressing portion 102 is provided to an exterior cover 101 forming a part of an exterior in this modification example. The exterior cover 101 is fixed to the main frame 52 of the printer 1. Specifically, a position of the exterior cover 101 with respect to the main frame 52 is restricted in such a manner that positioning portions 104*a* and 104*b* of the exterior cover 101 are inserted into opening portions formed in the main frame 52. In this state, stopper hooks 105*a* and 105*b* are engaged with the main frame 52 to be mounted to the main frame 52. In such a manner, it is preferred that the pressing portion 102 be arranged on the gravity center of the laser scanner 21.

Figure 16A:
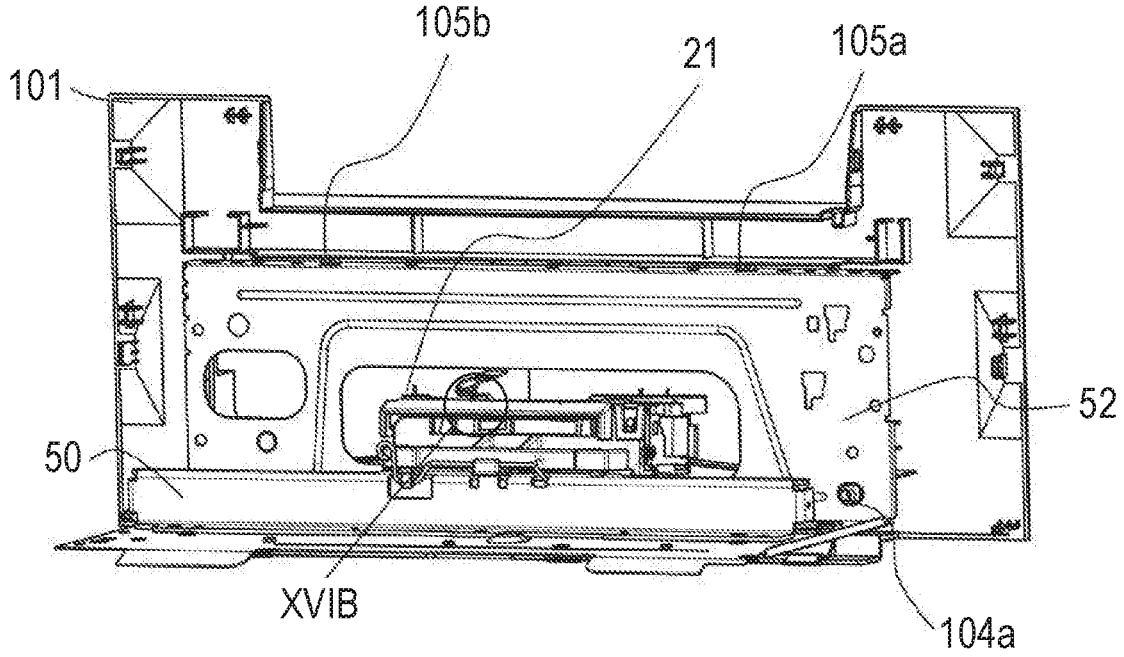
FIG. 16A is an explanatory view for illustrating a positional relationship between the exterior cover and the main frame in the another modification example.
Figure 16B:
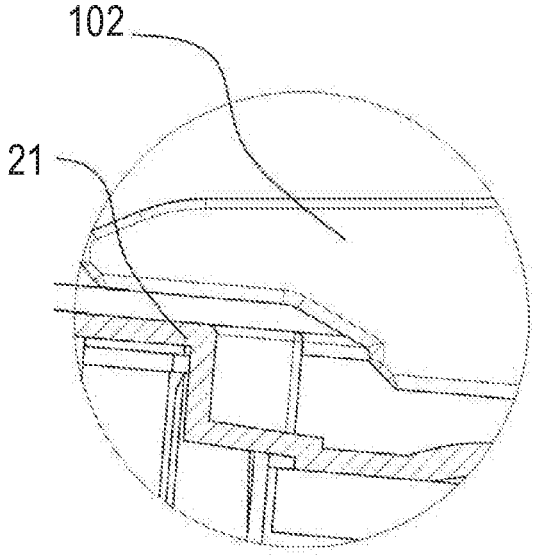
FIG. 16B is an enlarged view for illustrating the portion surrounded by the circle XVIB of FIG. 16A.

With the configuration described above, when the printer 1 vibrates along with the operation of the printer 1, the laser scanner 21 is prevented from significantly separating away from the main frame 52. For example, when a strong impact due to, for example, falling during distribution, the laser scanner 21 may separate in a direction of being removed from the main frame 52 with respect to the direction of being urged by the stay-side spring 57. However, through the arrangement of the pressing portion 102 through a space defined between the pressing portion 102 and the laser scanner 21 as illustrated in FIG. 16A and FIG. 16B, a certain shock can be absorbed through use of the elasticity of the stay-side spring 57, and with regard to a shock exceeding a certain level, the laser scanner 21 is supported by the pressing portion 102, thereby being capable of alleviating the shock to be applied. The pressing portion 102 may be interposed between the laser scanner 21 and another component so that the laser scanner 21 is supported by the another member through intermediation of the pressing portion 102. Moreover, in order to prevent removal of the laser scanner 21 from the main frame 52 due to a strong shock applied to the laser scanner 21 caused by, for example, falling at the time of distribution, it is preferred that the gap be set smaller than the amount of insertion of the bosses 21C of the laser scanner 21 inserted into the through holes formed in the scanner positioning portion 50C of the scanner stay 50.

With the pressing portion 102 provided to the exterior cover 101, even when the opening portion of the main frame 52 cannot be narrowed, removal of the laser scanner 21 from the main frame 52 can be prevented. For example, it is also effective for the case in which the gap between the laser scanner 21 and the opening portion of the main frame 52 is large, such as a configuration in which the protruded portions are provided on the upper face of the laser scanner 21.

Further, widening the opening portion of the main frame 52 may lead to improvement in ease of assembly. Therefore, when there arises need for maintenance of the laser scanner 21, the laser scanner 21 can be easily removed by only removing one exterior cover 101, thereby being capable of also improving the service operability.

Figure 17:
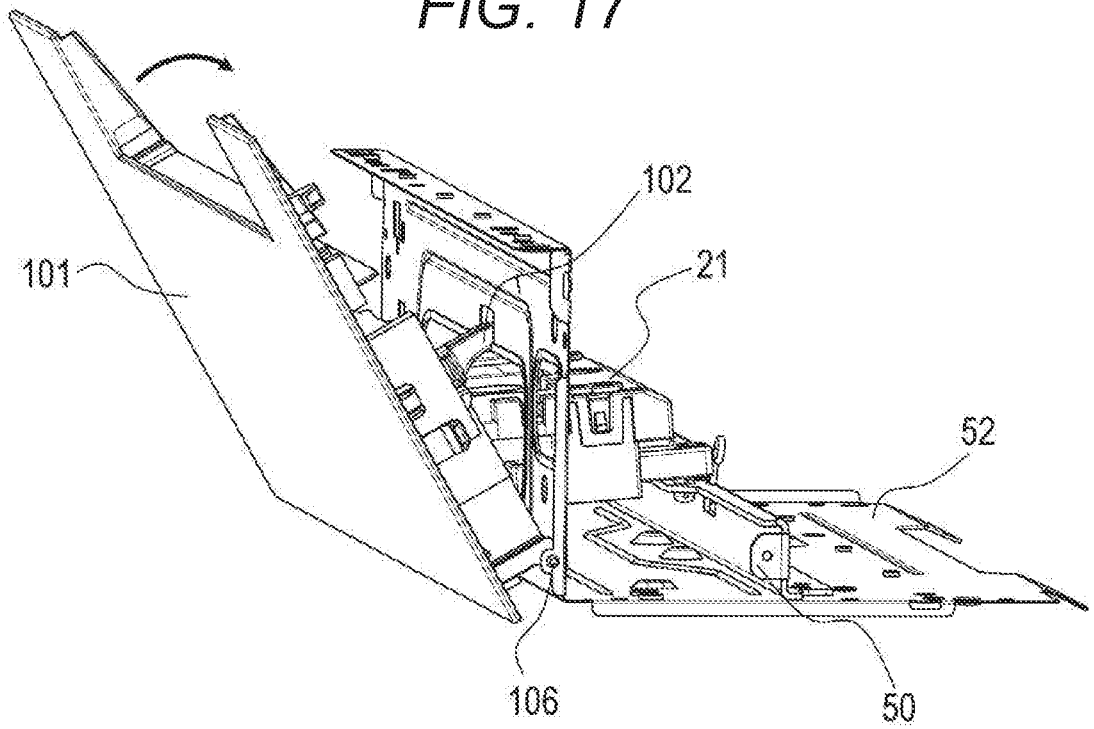
FIG. 17 is an exterior perspective view for illustrating the exterior cover and the main frame in the another modification example.
Figure 18:
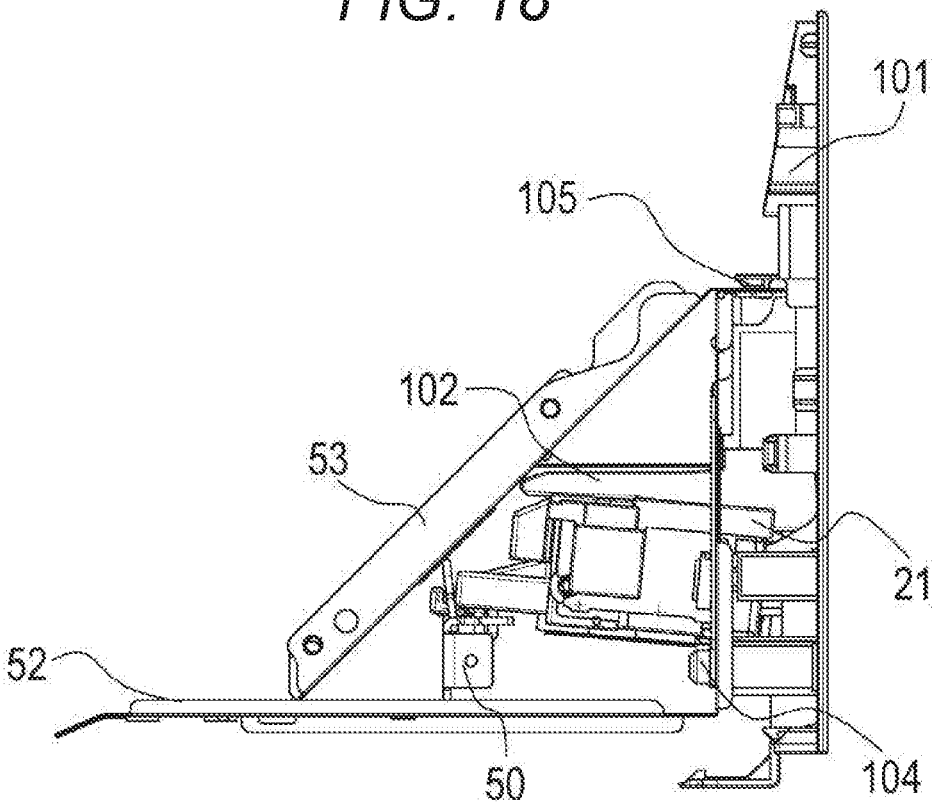
FIG. 18 is an explanatory view for illustrating a positional relationship between the exterior cover and the main frame in the another modification example.

In this modification example, the exterior cover 101 is always fixed to the main frame 52. However, there may be given a configuration in which the pressing portion 102 is provided to the exterior cover 101 that is openable and closable about a rotation fulcrum 106 as illustrated in FIG. 17 and FIG. 18. Here, FIG. 17 is an exterior perspective view for illustrating the exterior cover and the main frame of the modification example, and FIG. 18 is an explanatory view for illustrating a positional relationship between the exterior cover and the main frame of the modification example. In such a manner, the configuration can be suitably modified within the scope of the present disclosure.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefits of Japanese Patent Application No. 2019-197460, filed Oct. 30, 2019, Japanese Patent Application No. 2019-234670, filed Dec. 25, 2019, and Japanese Patent Application No. 2020-146177, filed Aug. 31, 2020, which are hereby incorporated by reference herein in their entirety.

What is claimed is:

1. An image forming apparatus configured to form an image on a recording material, the image forming apparatus comprising:

a photosensitive member;

an exposure device configured to form a latent image on the photosensitive member;

a tubular body defining a space in which at least a part of the exposure device is contained;

a support portion which is provided along a rotation axis direction of the photosensitive member in the space of the tubular body, and is configured to support the exposure device;

a first side plate fixed to one end portion of the tubular body in the rotation axis direction; and a second side plate fixed to another end portion of the tubular body in the rotation axis direction, wherein one end portion of the support portion in the rotation axis direction is fixed to the first side plate, and another end portion of the support portion in the rotation axis direction is fixed to the second side plate.

2. The image forming apparatus according to claim 1, wherein the tubular body has a shape of a triangle in a cross section taken along a direction orthogonal to the rotation axis direction.

3. The image forming apparatus according to claim 2, wherein the tubular body has a sectional shape of an uninterrupted annulus at the one end portion of the tubular body and the another end portion of the tubular body in the rotation axis direction.

4. The image forming apparatus according to claim 2, wherein the support portion is fixed to the tubular body.

5. The image forming apparatus according to claim 2, wherein the support portion is formed by a part of the tubular body.

6. The image forming apparatus according to claim 2, wherein the tubular body includes a first frame forming two sides of the triangle shape in the cross section taken along the direction orthogonal to the rotation axis direction, and includes a second frame forming one side of the triangle shape in the cross section taken along the direction orthogonal to the rotation axis direction, and wherein the first frame and the second frame are fixed to each other at a plurality of positions in the rotation axis direction.

7. The image forming apparatus according to claim 6, wherein the first frame includes a first face forming one side of the two sides of the triangle shape in the cross section taken along the direction orthogonal to the rotation axis direction, and includes a second face forming another side of the two sides of the triangle shape in the cross section taken along the direction orthogonal to the rotation axis direction, wherein the first face has an opening through which the exposure device is inserted into the space, and has a first abutting portion formed on a rim portion defining the opening, wherein the second face has the support portion having a second abutting portion, and wherein the exposure device includes a first abutted portion, which is provided on a trailing end side in a direction in which the exposure device is inserted into the opening, and is brought into abutment against the first abutting portion, and includes a second abutted portion, which is provided on a leading end side in the direction in which the exposure device is inserted into the opening, and is brought into abutment against the second abutting portion.

8. The image forming apparatus according to claim 7, further comprising fixing members configured to fix the first abutting portion and the first abutted portion to each other and fix the second abutting portion and the second abutted portion to each other.

9. The image forming apparatus according to claim 1, wherein the support portion includes a first protruded portion provided at one end portion of the support portion in the rotation axis direction, and a second protruded portion provided at another end portion of the support portion in the rotation axis direction, wherein the first side plate has an opening into which the first protruded portion is inserted, and wherein the second side plate has an opening into which the second protruded portion is inserted.

* * * * *